US009186926B2

(12) United States Patent
Nonaka

(10) Patent No.: US 9,186,926 B2
(45) Date of Patent: Nov. 17, 2015

(54) SHEET PROCESSING APPARATUS, METHOD FOR CONTROLLING THE SAME, STORING MEDIUM, AND PROGRAM

(71) Applicant: CANON KABUSHIKI KAISHA, Tokyo (JP)

(72) Inventor: Takashi Nonaka, Kunitachi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/163,152

(22) Filed: Jan. 24, 2014

(65) Prior Publication Data

US 2014/0140789 A1 May 22, 2014

Related U.S. Application Data

(63) Continuation of application No. 12/689,185, filed on Jan. 18, 2010, now Pat. No. 8,672,312.

(30) Foreign Application Priority Data

Jan. 20, 2009 (JP) ..... 2009-010144

(51) Int. Cl.

| | |
|---|---|
| ***B65H 37/04*** | (2006.01) |
| ***B42C 19/04*** | (2006.01) |
| ***B41L 43/12*** | (2006.01) |
| ***B65H 37/06*** | (2006.01) |
| ***B42B 4/00*** | (2006.01) |
| *B65H 45/18* | (2006.01) |

(52) U.S. Cl.

CPC ..... *B42C 19/04* (2013.01); *B41L 43/12* (2013.01); *B42B 4/00* (2013.01); *B65H 37/04* (2013.01); *B65H 37/06* (2013.01); *B65H 45/18* (2013.01); *B65H 2301/4505* (2013.01); *B65H 2511/30* (2013.01); *B65H 2511/414* (2013.01)

(58) Field of Classification Search

CPC ..... B65H 37/04; B65H 37/06; B65H 45/04; B65H 2301/4505; B41L 43/12

USPC ..... 270/37, 45, 58.07, 58.08; 412/6, 33

See application file for complete search history.

(56) References Cited

U.S. PATENT DOCUMENTS

| | | | | |
|---|---|---|---|---|
| 6,746,390 | B2 * | 6/2004 | Tamura et al. | 493/445 |
| 2010/0194018 | A1 * | 8/2010 | Taguchi | 270/37 |

FOREIGN PATENT DOCUMENTS

| | | | |
|---|---|---|---|
| JP | H07-157178 | | 6/1995 |
| JP | 2002-068576 | A | 3/2002 |
| JP | 2002068576 | A * | 3/2002 |
| JP | 2002-145517 | | 5/2002 |

* cited by examiner

*Primary Examiner* — Leslie A Nicholson, III

(74) *Attorney, Agent, or Firm* — Canon USA, Inc. IP Division

(57) ABSTRACT

A control includes causing a processing unit to perform a saddle-stitching binding process in which a plurality of sheets are subjected to a binding process and a folding process or a center-folding binding process in which a plurality of sheets are subjected to the folding process, permitting the processing unit to perform the saddle-stitching binding process or the center-folding binding process on a predetermined number of sheets, and controlling such that the number of sheets which are permitted to be subjected to the center-folding binding process is smaller than the number of sheets which are permitted to be subjected to the saddle-stitching binding process.

11 Claims, 27 Drawing Sheets

FIG. 23

| NUMBER OF SHEETS | OUTPUT FORM | OUTPUT DESTINATION | SUPPLEMENTARY INFORMATION |
|---|---|---|---|
| 1 | 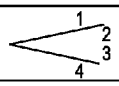 | SHEET OUTPUT TRAY 330 | |
| 2 | 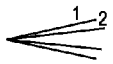 | SHEET OUTPUT TRAY 330 | |
| 3 | 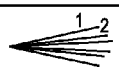 | SHEET OUTPUT TRAY 330 | |
| 4 | 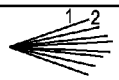 | SHEET OUTPUT TRAY 330 | |
| 5 | 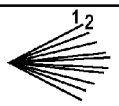 | SHEET OUTPUT TRAY 330 | |
| 6 | 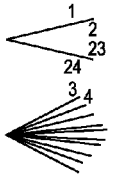 | SHEET OUTPUT TRAY 330 | A BUNDLE INCLUDING 5 SHEETS IS OUTPUT FIRST, AND ONE SHEET (SHOWN IN AN UPPER PORTION OF A LEFT DRAWING) IS OUTPUT NEXT |
| 7 | 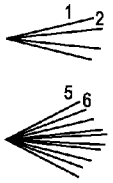 | SHEET OUTPUT TRAY 330 | A BUNDLE INCLUDING 5 SHEETS IS OUTPUT FIRST, AND A BUNDLE INCLUDING 2 SHEETS (SHOWN IN AN UPPER PORTION OF A LEFT DRAWING) IS OUTPUT NEXT |
| ... | ... | ... | |
| 20 | 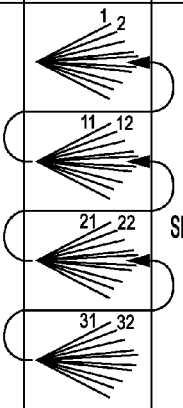 | SHEET OUTPUT TRAY 330 | BUNDLES EACH OF WHICH INCLUDES 5 SHEETS ARE SUCCESSIVELY OUTPUT FROM BELOW AS SHOW IN LEFT DRAWING, AND A SHEET BUNDLE OUTPUT FIRST IS INSERTED IN THE MIDDLE OF THE SHEET BUNDLES SUCCESSIVELY OUTPUT AND STACKED. |
| 21 TO | ... | SHEET OUTPUT TRAY 300 | |

SHEET PROCESSING APPARATUS, METHOD FOR CONTROLLING THE SAME, STORING MEDIUM, AND PROGRAM

CROSS-REFERENCE TO RELATED APPLICATION

This application is a Continuation of U.S. application Ser. No. 12/689,185, filed Jan. 18, 2010, which claims priority from Japanese Patent Application No. 2009-010144 filed Jan. 20, 2009, which are hereby incorporated by reference herein in their entireties.

BACKGROUND OF THE INVENTION

1. Field of the Invention

The present invention relates to a sheet processing apparatus, a method for controlling the sheet processing apparatus, a storage medium, and a program.

2. Description of the Related Art

In general, known sheet processing apparatuses include a sheet processing apparatus which performs a saddle-stitching binding process (refer to Japanese Patent Laid-Open No. 2008-013275). In the saddle-stitching binding process, after center portions of a plurality of sheets are bound, the bound sheets are folded into two so as to form a book shape and output.

When such a sheet processing apparatus performs the saddle-stitching binding process, a plurality of sheets are folded, and the plurality of folded sheets are conveyed by conveying rollers so as to be output. Note that since the plurality of sheets which are to be conveyed have been bound, the sheets are not considerably shifted from one another while the sheets are conveyed.

Furthermore, a center-folding binding process may be executed using a system the same as that used in the saddle-stitching binding process. In the center-folding binding process, a plurality of sheets which are not bound but folded can be conveyed.

However, when the center-folding binding process is performed, since the plurality of sheets to be conveyed are not bound, only a smaller number of sheets can be conveyed in a stable state when compared with a case of the saddle-stitching binding process. This is because a large number of sheets are not stably conveyed in a state in which the sheets are folded since the conveying rollers does not have sufficient force to sandwich and hold the sheets.

Therefore, when a number of sheets which can be reliably subjected to the saddle-stitching binding process are subjected to the center-folding binding process, the sheets to be output may be shifted from one another while the sheets are conveyed after the center-folding binding process is performed.

SUMMARY OF THE INVENTION

The present invention provides a sheet processing apparatus including a processing unit configured to cause a sheet processing unit to perform a saddle-stitching binding process in which a plurality of sheets are subjected to a binding process and a folding process or a center-folding binding process in which a plurality of sheets are not subjected to the binding process but subjected to the folding process, and a control unit configured to permit the sheet processing unit to perform the saddle-stitching binding process or the center-folding binding process on a predetermined number of sheets. The control unit performs control such that the number of sheets which are permitted to be subjected to the center-folding binding process is smaller than the number of sheets which are permitted to be subjected to the saddle-stitching binding process.

Further features of the present invention will become apparent from the following description of exemplary embodiments with reference to the attached drawings.

BRIEF DESCRIPTION OF THE DRAWINGS

FIG. 23 is a diagram illustrating still another layout method according to the embodiment.

DESCRIPTION OF THE EMBODIMENTS

Figure 1:
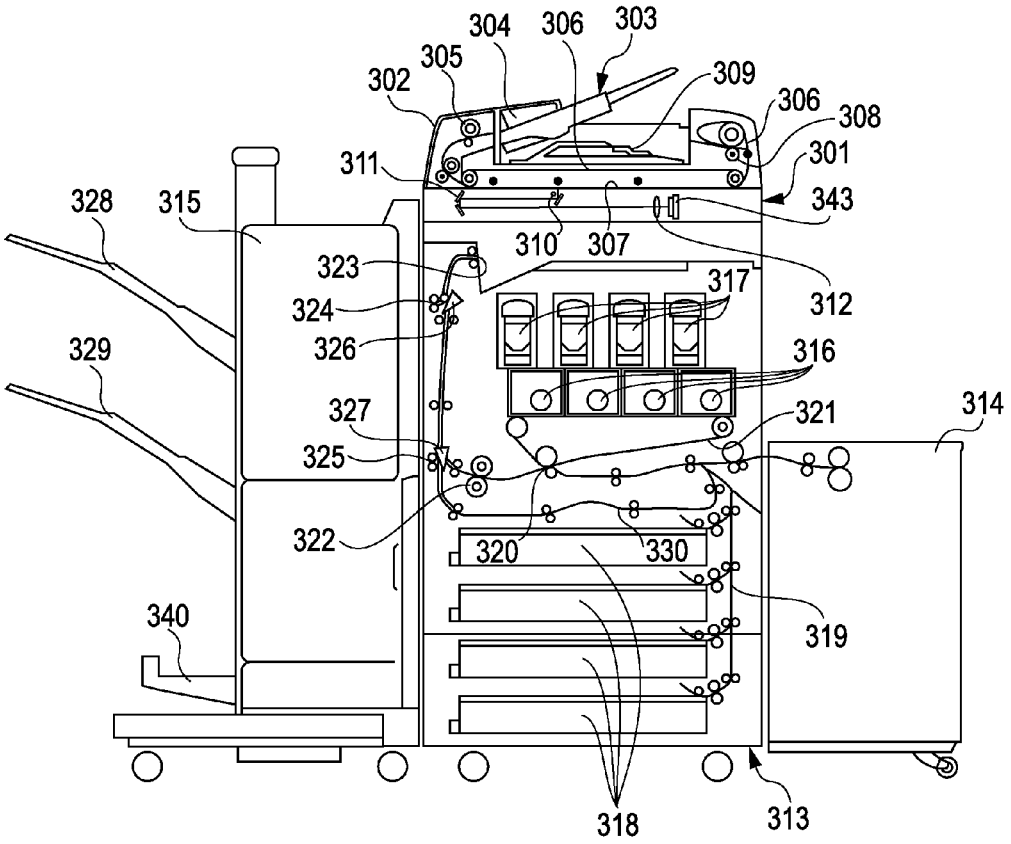
FIG. 1 is a diagram illustrating an image forming apparatus according to an embodiment of the present invention.
Figure 2:
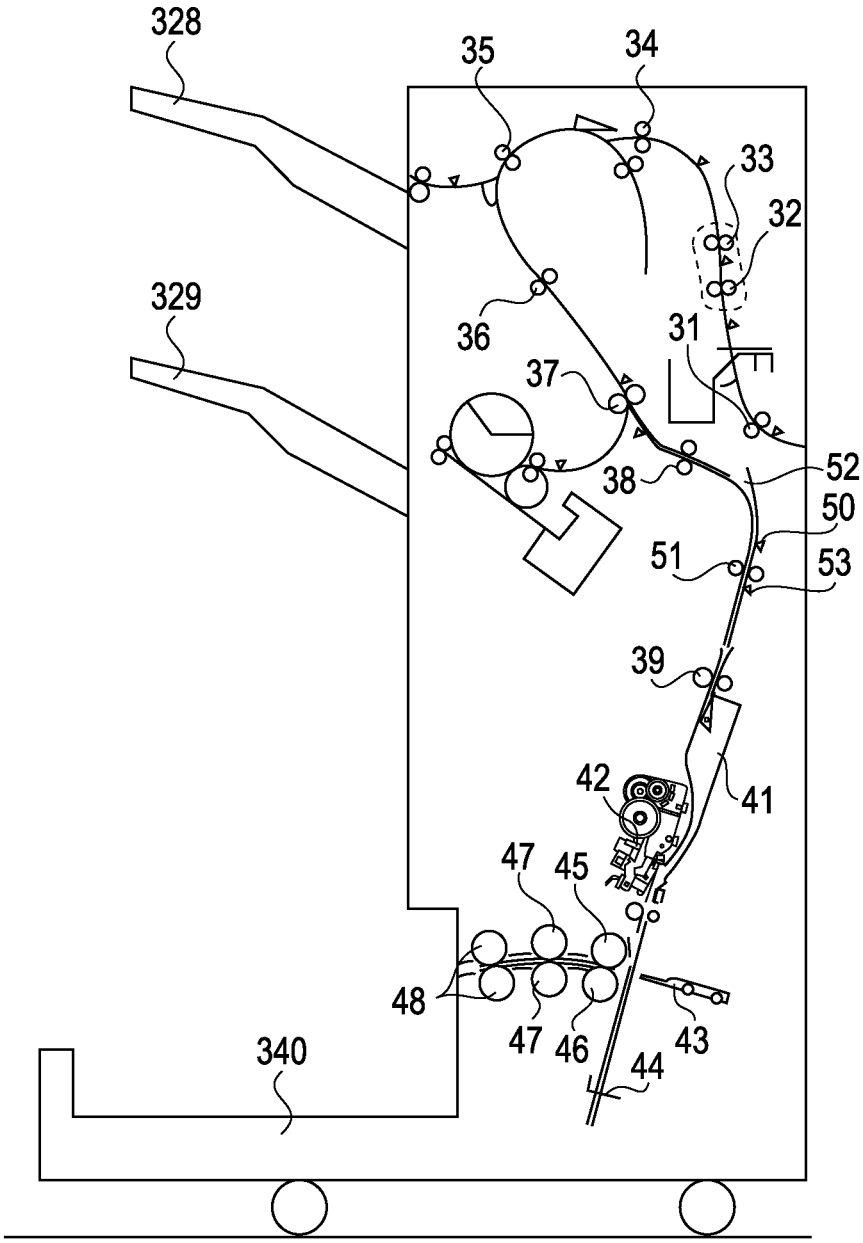
FIG. 2 is a diagram illustrating a configuration of a finisher according to the embodiment.

FIG. 1 is a diagram illustrating an image forming apparatus 100 which is an example of a sheet processing apparatus according to an embodiment of the present invention.

In this embodiment, a multifunction peripheral having a copy function, a printer function, and a facsimile function is taken as an example of the image forming apparatus 100. However, the image forming apparatus 100 may be an apparatus having a single function.

In FIG. 1, the image forming apparatus 100 includes a scanner 301, a document feeder (DF) 302, a printer 313 including four color-ink drams, a paper-feeding deck 314, and a finisher 315.

First, a reading process performed mainly by the scanner 301 will be described.

In a case where a reading process is to be performed by setting an original document on an original document plate 307, a user sets the original document on the original document plate 307 and closes the DF 302. When an opening/closing sensor detects that the DF 302 is closed, a reflection-type original-size detection sensor included in a housing of the scanner 301 detects the size of the set original document. When the size of the original document is detected, a light source 310 irradiates the original document with light, and the irradiated light is incident into a CCD sensor 343 through a lens 312. The CCD sensor 343 converts the incident light into a digital signal and transmits the digital signal to a controller of the scanner 301. The controller performs certain image processing on the received digital signal, converts the digital signal into a laser recording signal, and stores the laser recording signal as image data in a memory.

In a case where a reading process is to be performed by setting an original document on the DF 302, the user sets the original document on a tray of an original document setting unit 303 of the DF 302 in a face-up state. When the original document is set, an original document sensor 304 detects the set original document. When the original document sensor 304 detects the set original document, the controller rotates an original document feeding roller 305 and a conveying belt 306 so as to convey the original document to a predetermined position on the original document plate 307. When the original document is conveyed to the predetermined position, the controller performs a reading process the same as that performed in the case where the original document is set on the original document plate, and image data is stored in the memory. Then, the original document which has been subjected to the reading process is output to a paper output tray 309 through a conveying roller 308. In a case where a plurality of original documents are set on the DF 302, the controller outputs one of the original documents which has been subjected to the reading process, and simultaneously, feeds the other one of the original documents to be subjected to the reading process through the original feeding roller 305. In this way, the plurality of original documents are read.

Next, a printing process performed by the printer 313 will be described.

A recording signal (printing image data) which has been stored in the memory included in the controller is transmitted to the printer 313 and is converted into recording laser beams of yellow, magenta, cyan, and black using a laser recording unit. Then, the recording laser beams are irradiated onto photosensitive bodies 316 corresponding to the colors so as to form electrostatic latent images in the photosensitive bodies 316. Then, toner development is performed using tonner supplied from tonner cartridges 317 and visible images are primarily transferred on an intermediate transfer belt 321. Thereafter, when the intermediate transfer belt 321 rotates in the clockwise direction, and when a recording sheet which has been fed from one of paper cassettes 318 and the paper-feeding deck 314 through a feeding paper conveying path 319 is supplied to a secondary transferring position 320, an image is transferred from the intermediate transfer belt 321 to the recording sheet. The tonner which is used to transfer the image on the recording sheet is fixed by pressure and heat by a fixing unit 322 and the recording sheet is conveyed through an ejecting paper conveying path. Then, the recording sheet is output to a center tray 323 in a face-down state, an outlet 324 to a finisher after being switched back, or a side tray 325 in a face-up state. Flappers 326 and 327 are used to switch conveying paths from one to another in order to switch these outlets from one to another. It is assumed that duplex printing is to be performed. After the recording sheet passes through the fixing unit 322, the flapper 327 selects one of the conveying paths, and thereafter, the sheet is supplied to a lower portion after being switched back, and further supplied to the secondary transferring position 320 again through a duplex-printing paper conveying path 330. In this way, the duplex printing is realized.

This duplex circulating control is performed in a conveying path including the duplex-printing paper conveying path 330, the secondary transferring position 320, and the fixing unit 322. Sheets of an A4 size and a LTR size are subjected to five-sheet circulating control, and sheets larger than the A4 size and the LTR size are subjected to three-sheet circulating control.

Next, a process performed by the finisher 315 will be described. The finisher 315 performs post-processing on sheets in accordance with a setting specified by the user. Specifically, the finisher 315 has a stapler function (binding at a portion or two portions), a punching function (making two holes or three holes), and a function of a saddle-stitching binding process. The finisher 315 shown in FIG. 1 includes two sheet output trays 328 and 329. A sheet which is supplied through the outlet 324 to the finisher 315 is sorted to one of the output trays in accordance with a user's setting, for example, depending on the copy function, the printing function, or the facsimile function. When the finisher 315 is used as a printer, a driver is used to perform various settings including a setting of monochrome printing/color printing, a setting of a sheet size, a setting of 2UP printing, 4UP printing, or N-UP printing, a setting of duplex printing, a setting of stapling, a setting of punching, a setting of saddle-stitching binding, a setting of an inserted sheet, a setting of a front cover, and a setting of a back cover.

Operation of Binding Apparatus

A configuration and operation of the finisher 315 will be described with reference to FIGS. 2 to 7.

The finisher 315 includes conveying rollers 31 to 39, sheet-member tip detection sensors 50 and 53, a stapler 42, a pushing plate 43, a stopper 44, folding rollers 45 and 46, and an output tray 49. The finisher 315 may operate in accordance with a command issued by a controller included in the image forming apparatus 100 or may operate under control of a controller of the finisher 315.

A sheet supplied from the image forming apparatus 100 is output to one of the sheet output trays 328 and 329 and a sheet output tray 340 in accordance with a type of sheet process set by the user.

For example, when any sheet process is not performed, the sheet is output to the sheet output tray 328. When a normal stapling process is performed, the sheet is output to the sheet output tray 329. When the saddle-stitching binding process or the center-folding binding process is performed, the sheet is output to the sheet output tray 340.

Figure 3:
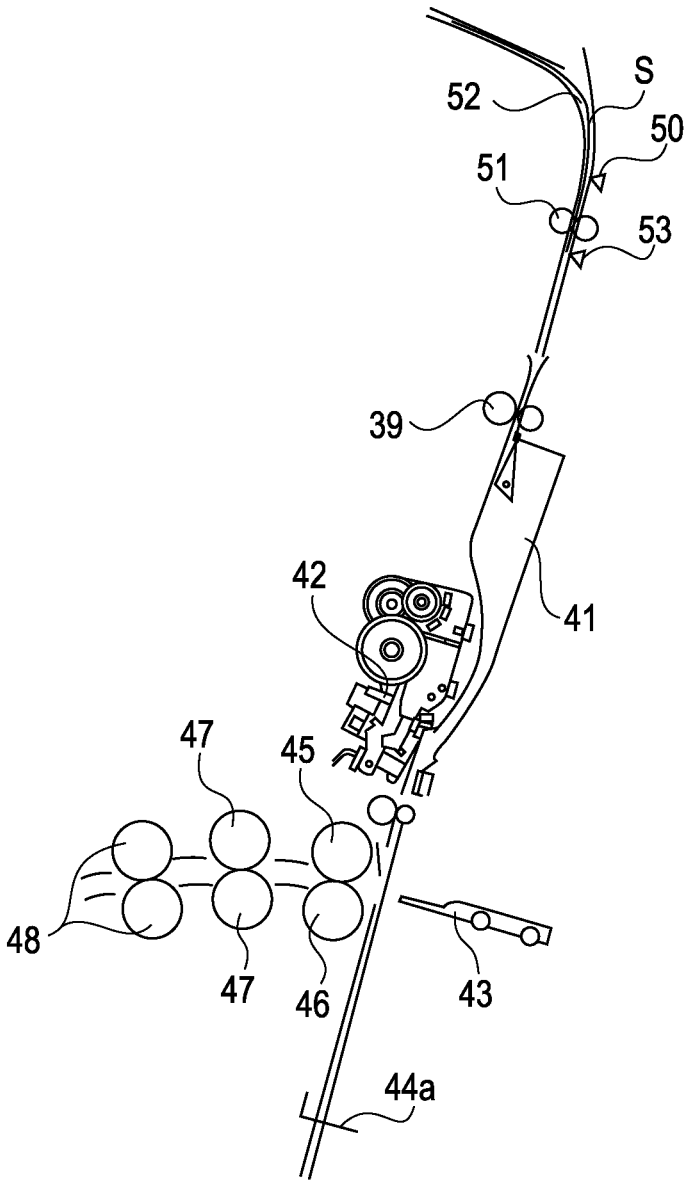
FIG. 3 is a diagram illustrating another configuration of the finisher according to the embodiment.

The sheet supplied from the image forming apparatus 100 is further supplied by the conveying rollers 31 to 38 until a tip end of the sheet reaches the sheet-member tip detection sensor 50. When the sheet-member tip detection sensor 50 detects the tip end of the sheet, a speed of the conveying roller 38 which sandwiches and holds the sheet is reduced, and the tip end of the sheet abuts on a nip of an oblique correction roller 51 (as shown in FIG. 3).

The conveying roller 38 rotates for a while after the tip end of the sheet abuts on the nip of the oblique correction roller 51. Then, after the sheet forms a loop in a loop space 52, the conveying roller 38 is stopped.

Next, the oblique correction roller 51 starts rotating. When the sheet is obliquely supplied, the oblique correction roller 51 performs oblique correction on the sheet. The sheet which has been subjected to the oblique correction is supplied toward the conveying roller 39. When the sheet-member tip detection sensor 53 detects the tip end of the sheet, the sheet is conveyed by a predetermined amount and the tip of the sheet abuts on a stopper 44*a* (as shown in FIG. 4).

Figure 4:
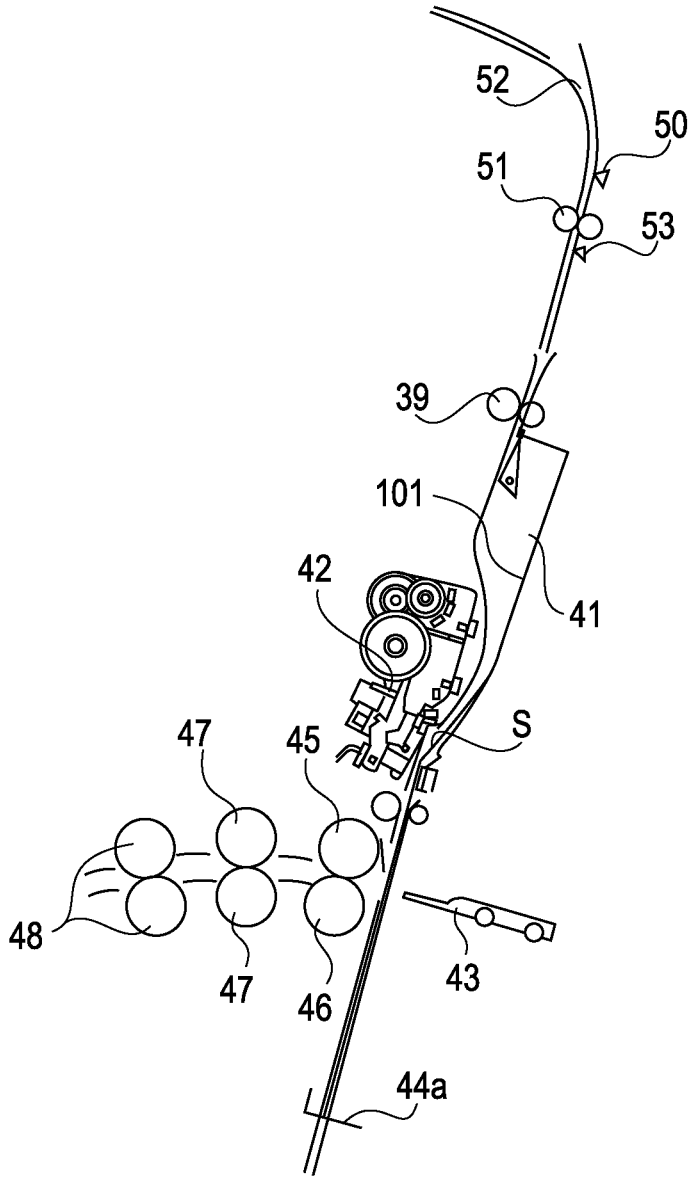
FIG. 4 is a diagram illustrating still another configuration of the finisher according to the embodiment.

In this case, as shown in FIG. 4, the sheet is positioned by the stopper 44*a* so that a center portion of the sheet is positioned in a portion where the stapler 42 performs a binding process. The processing described above is repeatedly performed whereby a plurality of sheets are successively conveyed into an internal space of a conveying-path 41.

When all the sheets which constitute a booklet are supplied to the internal space of the conveying-path 41, the sheets are aligned in a width direction by a width-direction alignment plate, not shown, so as to form a sheet bundle 101 in the internal space of the conveying-path 41.

Here, the sheets are successively conveyed into the internal space of the conveying-path 41 starting from one of the sheets which is positioned in the innermost side of the booklet to one of the sheets which serves as a front cover of the booklet.

Figure 5:
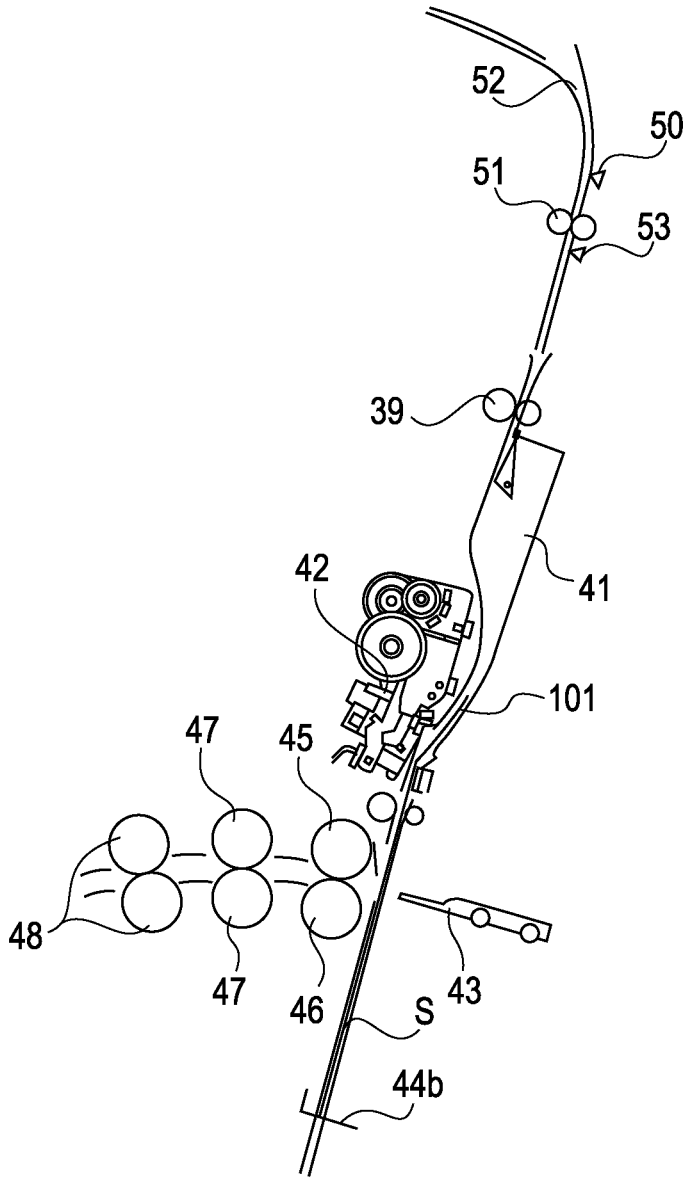
FIG. 5 is a diagram illustrating a further configuration of the finisher according to the embodiment.

When the saddle-stitching binding process has been set, the stapler 42 performs binding processing on the sheet bundle 101. After the stapler 42 binds the sheet bundle 101, the stopper 44*a* which has held the sheet bundle 101 moves toward a downstream side of a conveying direction so as to correspond to a stopper 44*b* (as shown in FIG. 5). When the stopper 44*a* moves, the sheet bundle 101 moves toward the downstream side of the conveying direction. On the other hand, when the saddle-stitching binding process has not been set but the center-folding binding process (or a saddle-folding binding process) has been set, the stopper is positioned in the stopper 44*b* from the beginning, and the stapling process to be performed by the stapler 42 is omitted.

Figure 6:
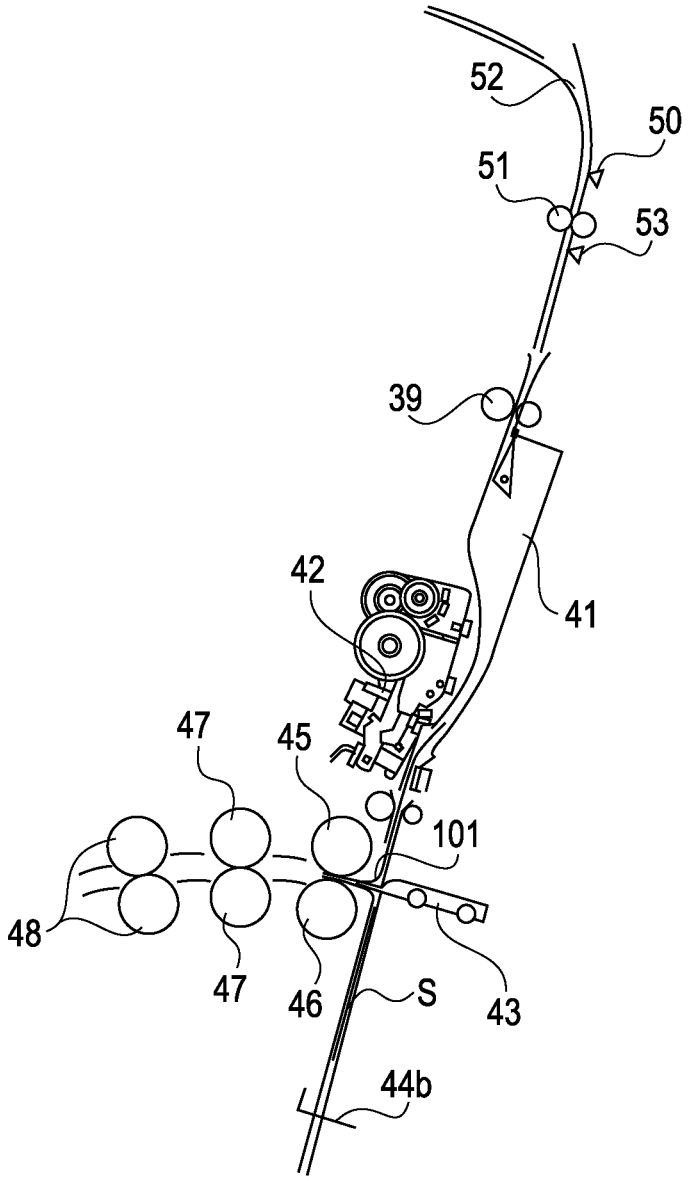
FIG. 6 is a diagram illustrating a still further configuration of the finisher according to the embodiment.

The stopper 44*b* performs positioning of the sheet bundle 101 so that a center portion of the sheet bundle 101 faces the pushing plate 43. An end of the pushing plate 43 abuts on a portion of the sheet bundle 101 in which a folding line is to be formed. The sheet bundle 101 is pushed into a nip between folding rollers 45 and 46 so that folding lines are formed on the sheets (as shown in FIG. 6).

Figure 7:
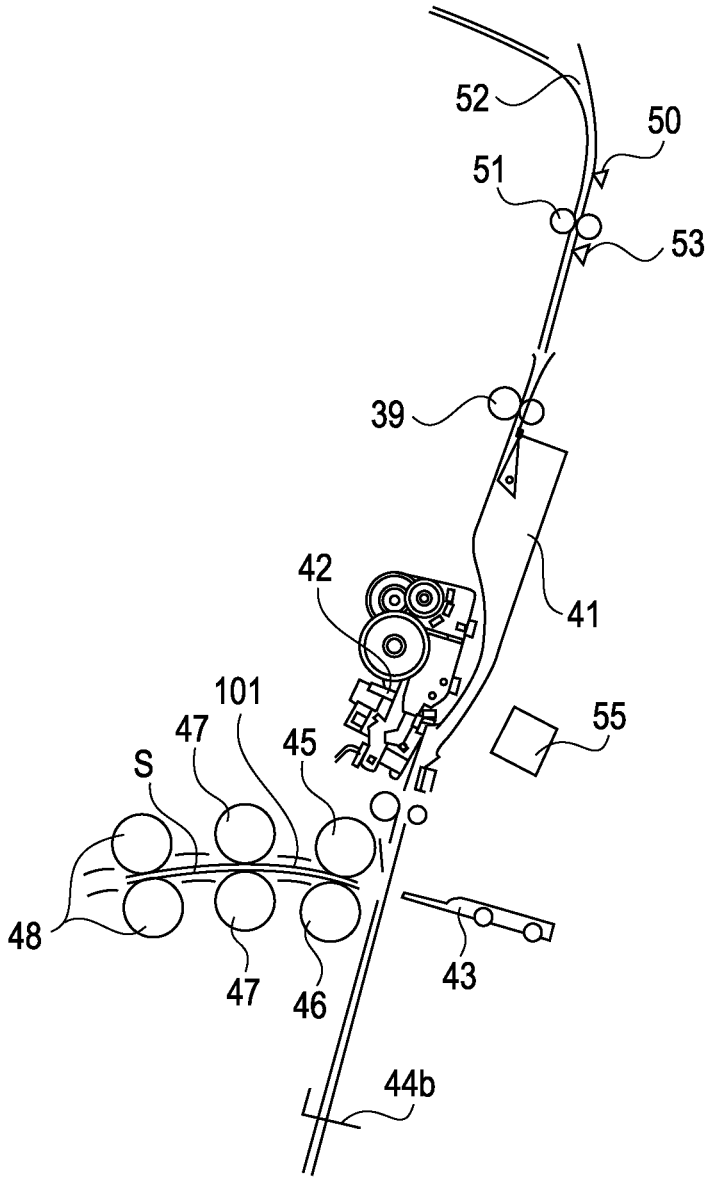
FIG. 7 is a diagram illustrating a yet further configuration of the finisher according to the embodiment.

The sheet bundle 101 in which the folding line is formed using the folding rollers 45 and 46 is output to the sheet output tray 340 using a pair of bundle conveying rollers 47 and a pair of bundle conveying rollers 48 (as shown in FIG. 7).

When the sheet bundle 101 is to be conveyed using the pairs of bundle conveying rollers 47 and 48 and when a binding process has been executed, the sheet bundle 101 is stably conveyed since the sheet bundle 101 is bound. However, when the binding process has not been performed, before the plurality of sheets are conveyed in a folding state, and when the sheet bundle 101 includes a large number of sheets, the stability is deteriorated when the sheet bundle 101 is conveyed when compared with the case where the binding process has been performed. The larger the number of sheets included in the sheet bundle 101 is, the lower the stability of the conveying sheets. Furthermore, it is highly likely that jam occurs due to a shifted sheet stuck in the conveying path.

Figure 8:
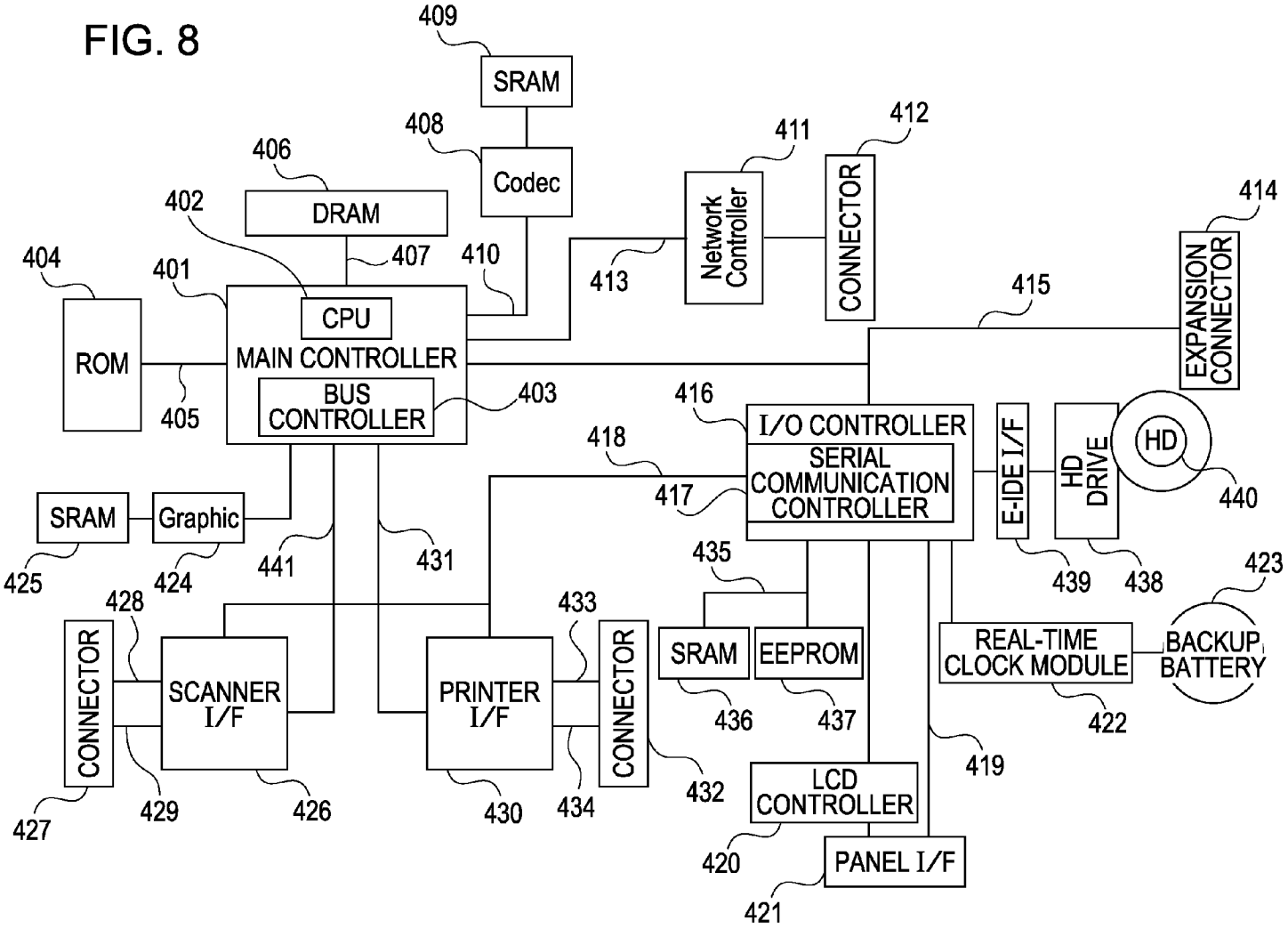
FIG. 8 is a block diagram illustrating a configuration of the image forming apparatus according to the embodiment.

Next, a hardware configuration of the controller which controls a scanner unit, a printer unit, and a network interface unit of the image forming apparatus 100 will be described in detail with reference to FIG. 8.

A main controller 401 mainly includes a CPU 402, a bus controller 403, and various I/F controller circuits.

The CPU 402 and the DF 302 control entire operation of the apparatus. The CPU 402 operates in accordance with a program read from a ROM (Read Only Memory) 404 through a ROM IF 405. The program further includes a description of a process of interpreting PDL (Page Description Language) code data and developing the code data into raster image data and is processed by software. The bus controller 403 controls transmission of data which is input from or output to various I/Fs, and performs bus mediation and control of DMA data transmission.

A DRAM 406 is connected to the main controller 401 through a DRAM I/F 407. The DRAM 406 is used as a work area for operation of the CPU 402 and a region which stores image data.

A codec 408 compresses raster image data stored in the DRAM 406 in an MH method, an MR method, an MMR method, a JBIG method, a JPEG method or the like, and conversely, decompresses code data which has been compressed and stored to obtain raster image data.

An SRAM 409 is used as a temporary work area of the codec 408. The codec 408 is connected to the main controller 401 through an I/F 410. Data transmission between the codec 408 and the DRAM 406 is performed as DMA transmission under control of the bus controller 403.

A graphic processor 424 performs processes such as image rotation, image magnification, color-space conversion, and binarization on the raster image.

An SRAM 425 is used as a temporary work area of the graphic processor 424. The graphic processor 424 is connected to the main controller 401 through an I/F. Data transmission between the graphic processor 424 and the DRAM 406 is performed as DMA transmission under control of the bus controller 403.

A network controller 411 is connected to the main controller 401 through an I/F 413, and connected to an external network through a connector 412. An example of the network generally includes an Ethernet (registered trademark). Printing data transmitted from an external PC (Personal Computer) is received under control of the network controller 411 and is supplied to the CPU 402. The CPU 402 stores the received printing data in the DRAM 406 or an HD 440 and processes the printing data.

A universal high-speed bus 415 is connected to an expansion connector 414 and an I/O controller 416. In this embodiment, a transmission of a command between the finisher 315 and the image forming apparatus 100 is performed through the universal high-speed bus 415. The I/O controller 416 includes a two-channel asynchronous serial communication controller 417 used to transmit a control command to and receive a control command from CPUs of the scanner unit 201 and the printer unit 203. The I/O controller 416 is connected to a scanner I/F circuit 426 and a printer I/F circuit 430 through an I/O bus 418.

A panel I/F 421 is connected to an LCD controller 420. The panel I/F 421 includes an I/F used to perform display in a liquid crystal screen included in an operating unit 501 and a key-input I/F used to perform input using hard keys and keys of a touch panel.

Figure 9:
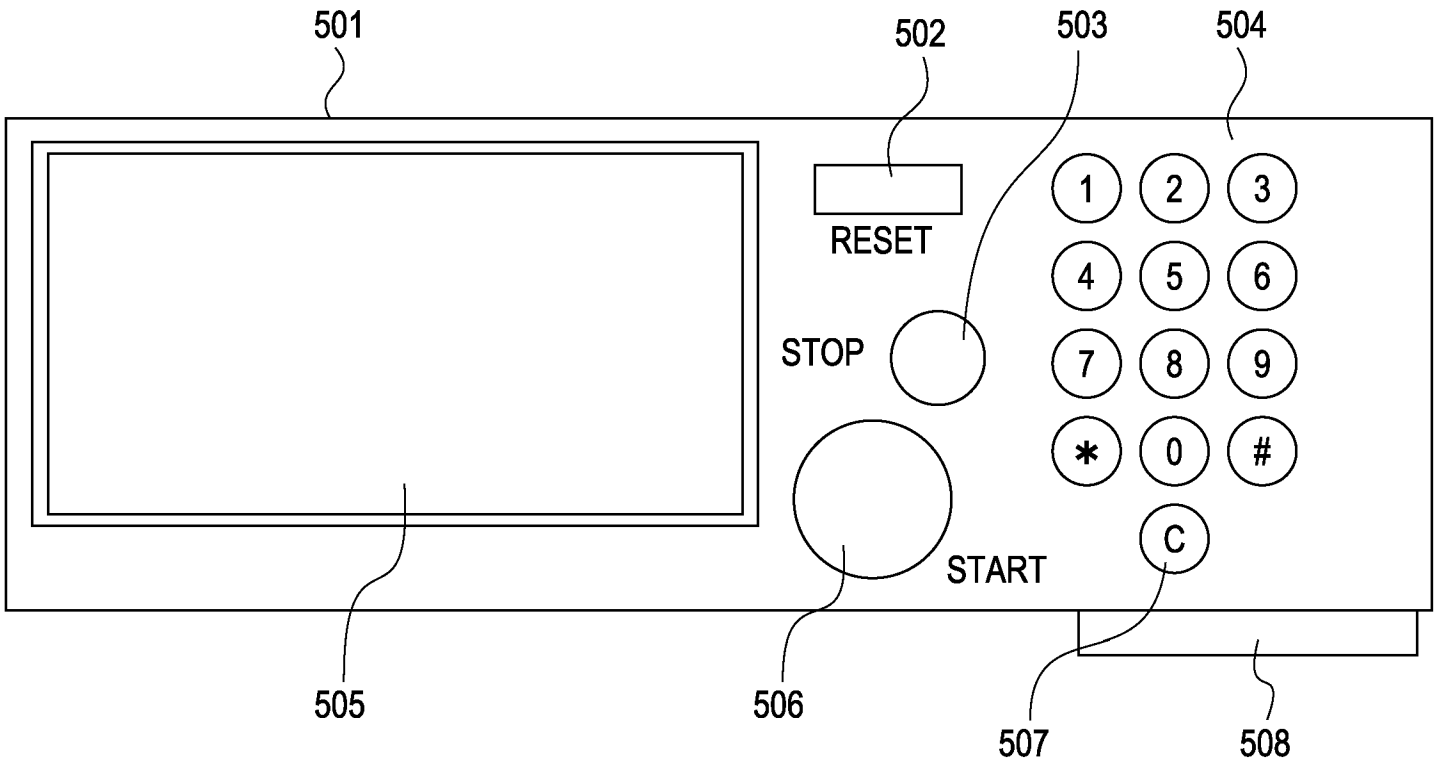
FIG. 9 is a diagram illustrating a configuration of an operating unit according to the embodiment.

The operating unit 501 shown in FIG. 9 includes a liquid crystal display unit, a touch panel input device disposed on the liquid crystal display unit, and a plurality of hard keys. A signal input using the touch panel or the hard keys is transmitted to the CPU 402 through the panel I/F 421. The liquid crystal display unit displays image data supplied from the panel I/F 421. The liquid crystal display unit displays a function in an operation of the image forming apparatus 100 and image data, for example. The operating unit 501 will be described in detail hereinafter.

A real-time clock module 422 updates and stores date and time to be managed in the apparatus, and a backup battery 423 backups the real-time clock module 422.

An E-IDE I/F 439 is used to connect an external storage device. In this embodiment, the CPU 402 controls the E-IDE I/F 439 to be connected to a hard disk drive 438, the image data is stored in the HD 440, and the image data is read from the HD 440. A connectors 427 is connected to the scanner unit 201 and includes an asynchronous serial I/F 428 and a video I/F 429. A connectors 432 is connected to the printer unit 203 and includes an asynchronous serial I/F 433 and a video I/F 434.

The scanner I/F circuit 426 is connected to the scanner unit 201 through the connectors 427, and is connected to the main controller 401 through a scanner bus 441. The scanner I/F circuit 426 has a function of performing a predetermined process on an image supplied from the scanner unit 201. The scanner I/F circuit 426 further has a function of outputting a control signal generated in accordance with a video control signal supplied from the scanner unit 201 to the scanner bus 441. A data transmission from the scanner bus 441 to the DRAM 406 is performed under control of the bus controller 403.

The printer I/F circuit 430 is connected to the printer unit 203 through the connectors 432, and is connected to the main controller 401 through a printer bus 431. The printer I/F circuit 430 has a function of performing a predetermined process on image data output from the main controller 401 and outputting the image data to the printer unit 203. The printer I/F circuit 430 further has a function of outputting a control signal generated in accordance with a video control signal supplied from the printer unit 203 to the printer bus 431. Raster image data developed in the DRAM 406 is transmitted to the printer unit 203 as DMA transmission through the printer bus 431 and the video I/F 434 under control of the bus controller 403.

An SRAM 436 can maintain stored data even when supply of electric power from a backup battery to the entire apparatus is blocked. The SRAM 436 is connected to the I/O controller 416 through a bus 435. Similarly, an EEPROM 437 is connected to the I/O controller 416 through the bus 435.

Next, the operating unit 501 will be described with reference to FIG. 9.

The user performs various printing settings using the operating unit 501.

A resetting key 502 is used to cancel a value, for example, set by the user. A stop key 503 is used to stop a job which is operating. A numeric keypad 504 is used to input a numerical value such as an entry.

A display unit 505 includes the touch panel and the liquid crystal display unit which are integrally configured. The display unit 505 displays various screens in the liquid crystal display unit in accordance with instructions issued by the CPU 402, and receives an instruction issued by the user through the touch panel.

A start key 506 is used to start a job such as reading of an original document. A clear key 507 is used to clear a setting, for example. A lamp 508 is turned on when a job is being executed or when an error occurs in the image forming apparatus 100 or the finisher 315 whereby states of the apparatuses are transmitted to the user.

Next, a screen displayed in the display unit 505 of the operating unit 501 will be described with reference to FIG. 10.

Figure 10:
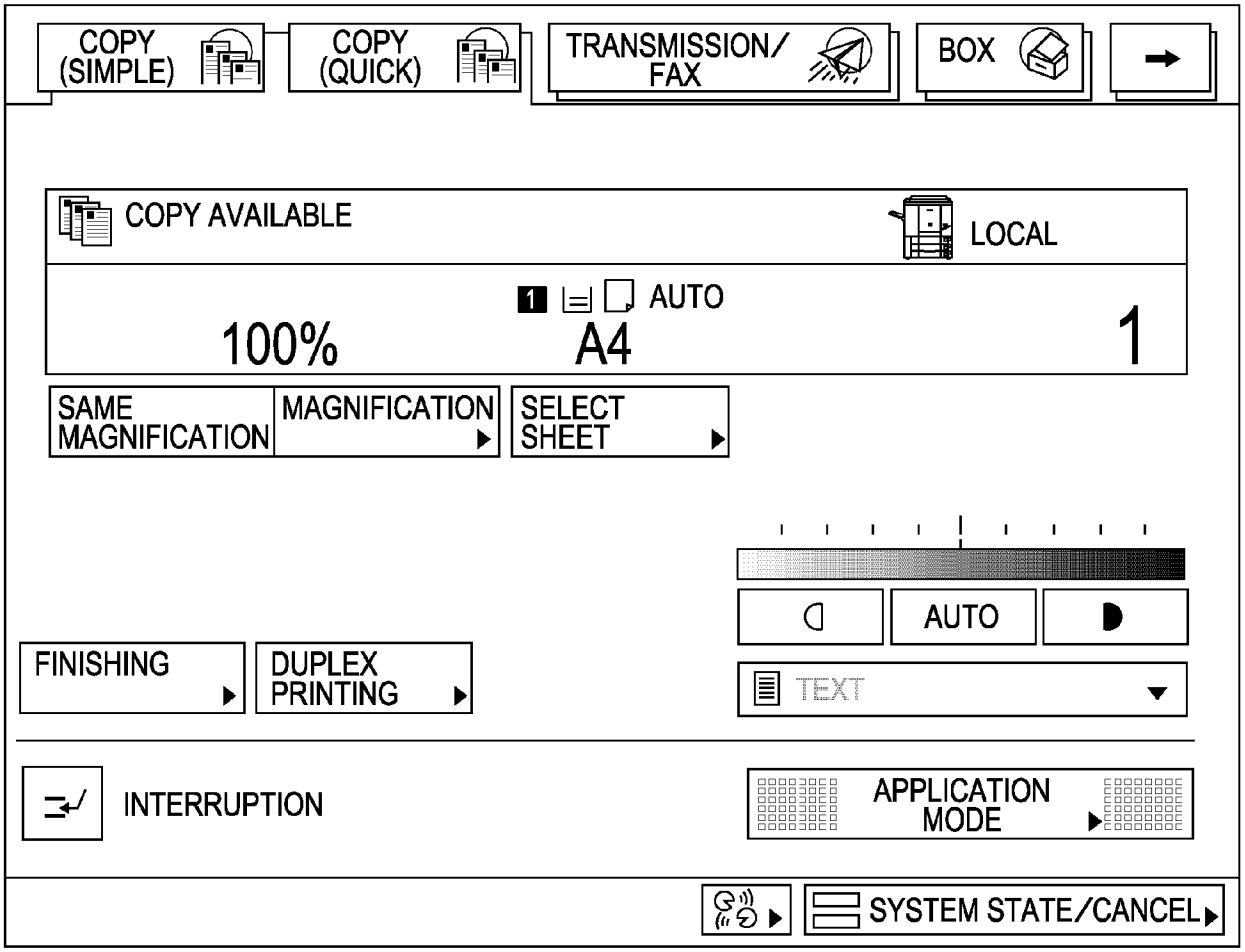
FIG. 10 is a diagram illustrating a screen displayed in a display unit according to the embodiment.

FIG. 10 is a diagram illustrating a standard screen displayed in the display unit 505.

Tags displayed in an upper portion of the screen are used to select various functions executable by the image forming apparatus 100. From the left, the tags represent a simple copy function, a quick copy function, a transmission/fax function, and a box function.

When the simple copy function or the quick copy function is used, image data representing an original document read by the scanner unit 201 is printed by the printer unit 203, and sheet processes such as a stapling process, a saddle-stitching process, and a center-folding process are performed where appropriate. The user can set a copy function while the simple copy function or the quick copy function is selected. Note that, in the quick copy function, a larger number of settings can be performed in a single screen when compared with the simple copy function.

When the transmission/fax function is used, facsimile transmission, e-mail transmission, and data transmission to a file server are performed.

When the box function is used, image data read by the scanner unit 201 is stored in the HD 440 or data stored in the HD 440 is operated and printed.

When each of the function tags is selected, a screen used to perform a corresponding setting in detail is displayed. FIG. 10 shows a copy setting screen in a state in which the simple copy function is selected which accept various settings relating to copy performed by the user. The copy setting screen shown in FIG. 10 includes a button for selecting color copy, monochrome copy, or automatic copy, a button for specifying single-sided copy or duplex copy, a button for specifying a magnification of copy, and a button for performing a sheet process. Two types of button can be used for the sheet process. The two types of button include a finishing button and an application button. The finishing button is used to display a screen for accepting a setting for performing a staple process of binding ends of sheets using a stapler. The application button is used to display a screen for accepting a setting for a sheet process such as the saddle-stitching binding process and the center-folding binding process performed by the finisher 315 which is connected to the image forming apparatus 100.

When a book is to be generated through the saddle-stitching binding process or the center-folding binding process, the user performs a setting for making the image forming apparatus 100 and the finisher 315 execute the binding process through screens shown in FIGS. 10 to 17. Note that the binding process in this specification includes the saddle-stitching binding process in which sheets are subjected to saddle stitching and the center-folding binding process in which sheets are folded in the middle thereof. After the user performs the setting for executing the binding process, the image forming apparatus 100 generates an image of layout (arrangement) of pages to be printed in accordance with the setting, and executes printing in accordance with the generated image. Then, the finisher 315 performs an appropriate sheet process in accordance with the setting.

The user first presses an "application mode" button in the screen shown in FIG. 10.

Figure 11:
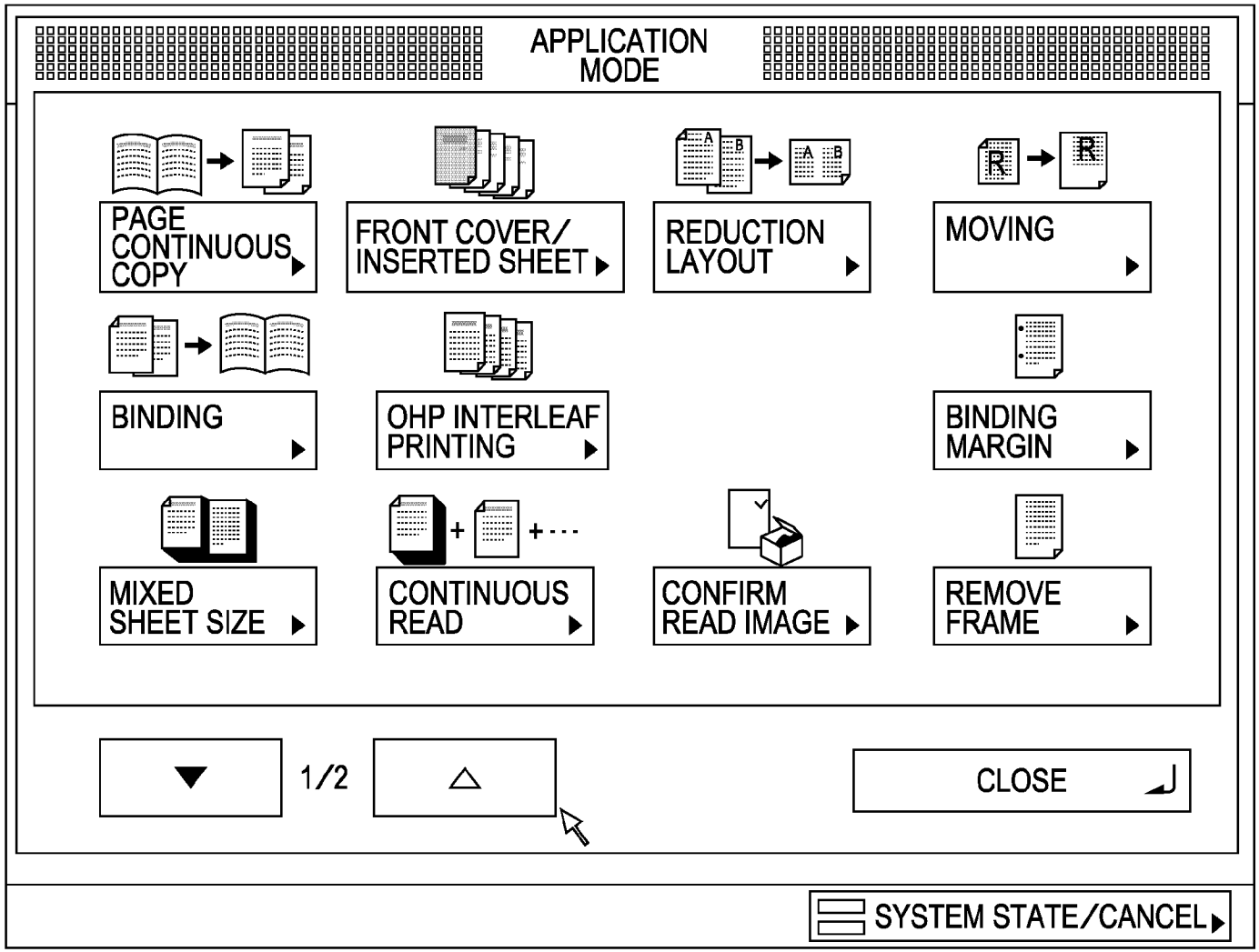
FIG. 11 is a diagram illustrating a screen displayed in a display unit according to the embodiment.
Figure 12:
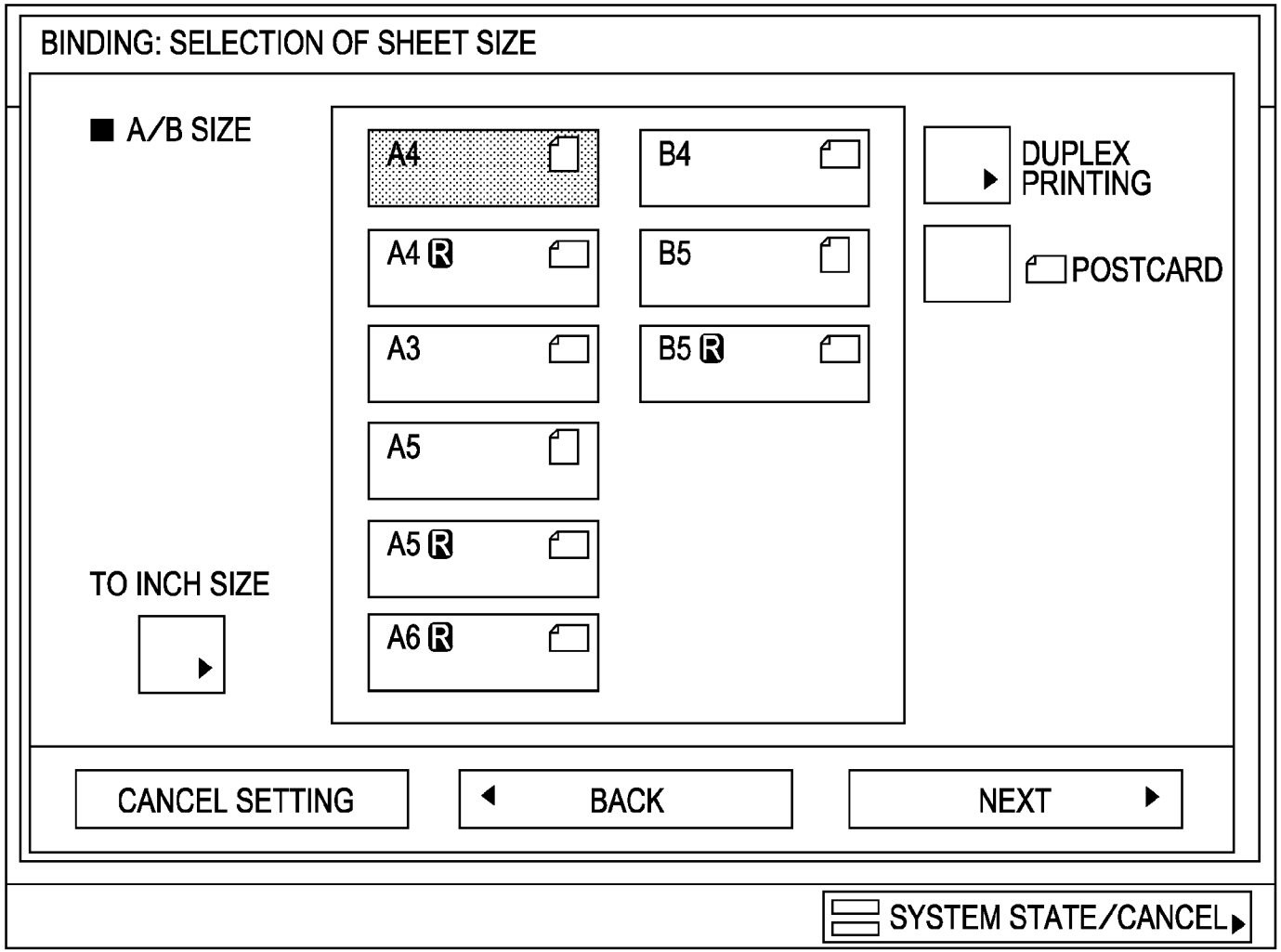
FIG. 12 is a diagram illustrating a screen displayed in a display unit according to the embodiment.
Figure 13:
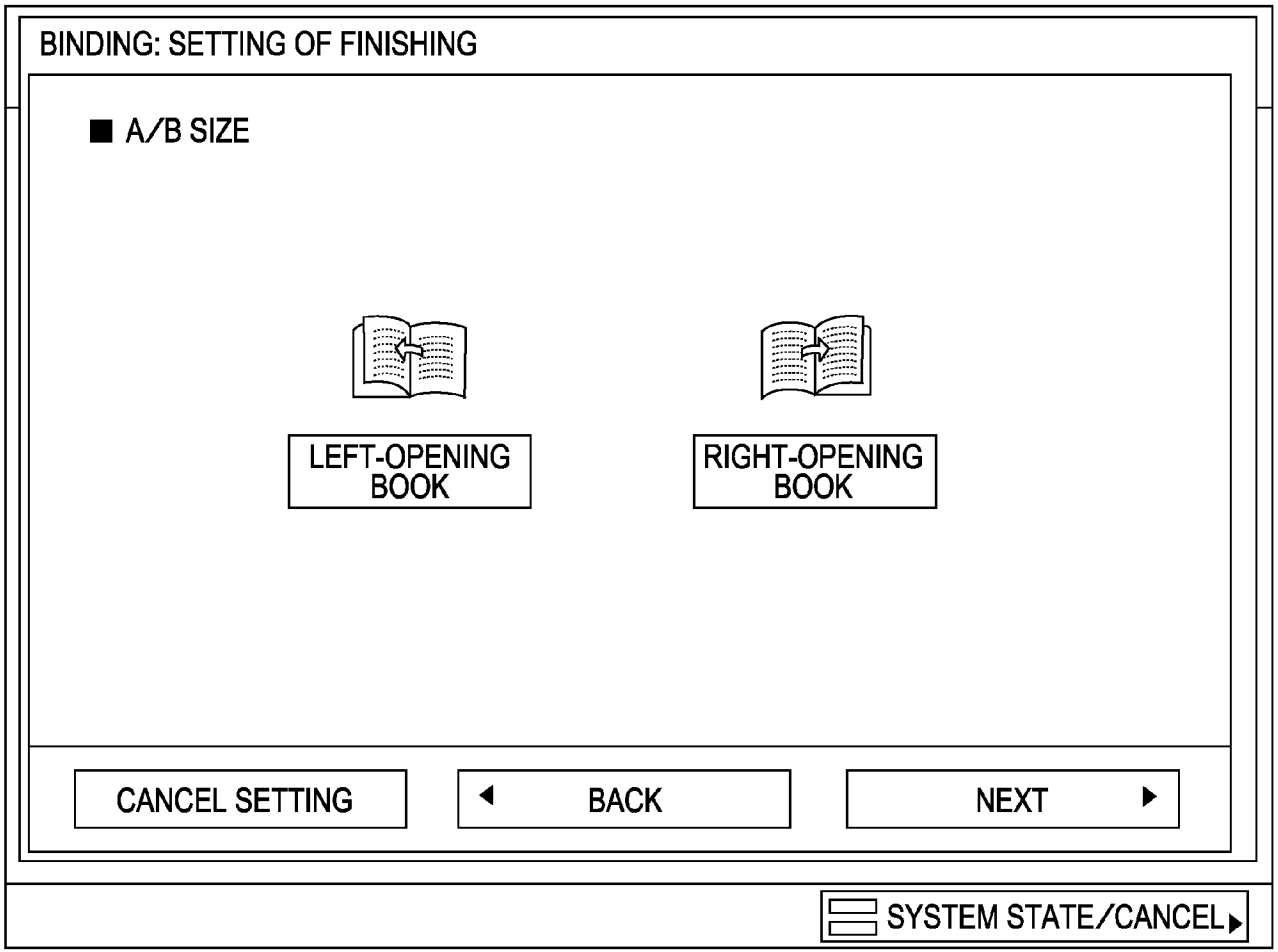
FIG. 13 is a diagram illustrating a screen displayed in a display unit according to the embodiment.
Figure 14:
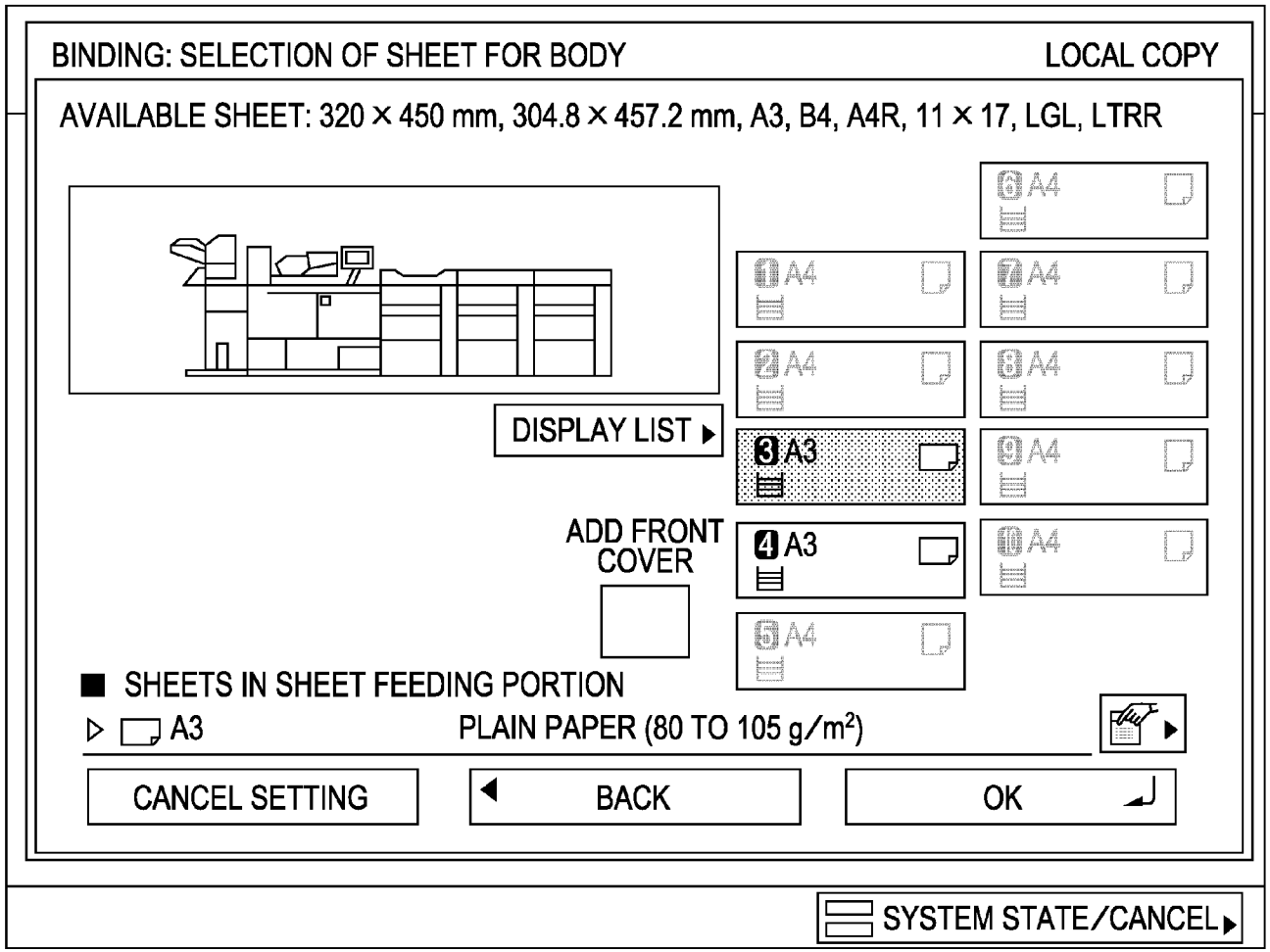
FIG. 14 is a diagram illustrating a screen displayed in a display unit according to the embodiment.

When the "application mode" button is pressed, a screen shown in FIG. 11 is displayed in the operating unit 501. When a "binding" button shown in FIG. 11 is pressed, the screen used for setting of a binding process is displayed as shown in FIG. 12. The user selects a size of original documents to be read using the screen shown in FIG. 12. In an example of FIG. 12, as the size of the original documents, an A4 size is specified. When a "next" button shown in FIG. 12 is pressed, the screen shown in FIG. 13 is displayed. The user selects a left-opening book or a right-opening book in the screen shown in FIG. 13. When a "next" button of the screen shown in FIG. 13 is pressed, the screen shown in FIG. 14 is displayed. The user selects a size of sheets to be a book using the screen shown in FIG. 14. Furthermore, the user may determine whether a front cover is attached to the book in the screen shown in FIG. 14.

Figure 15:
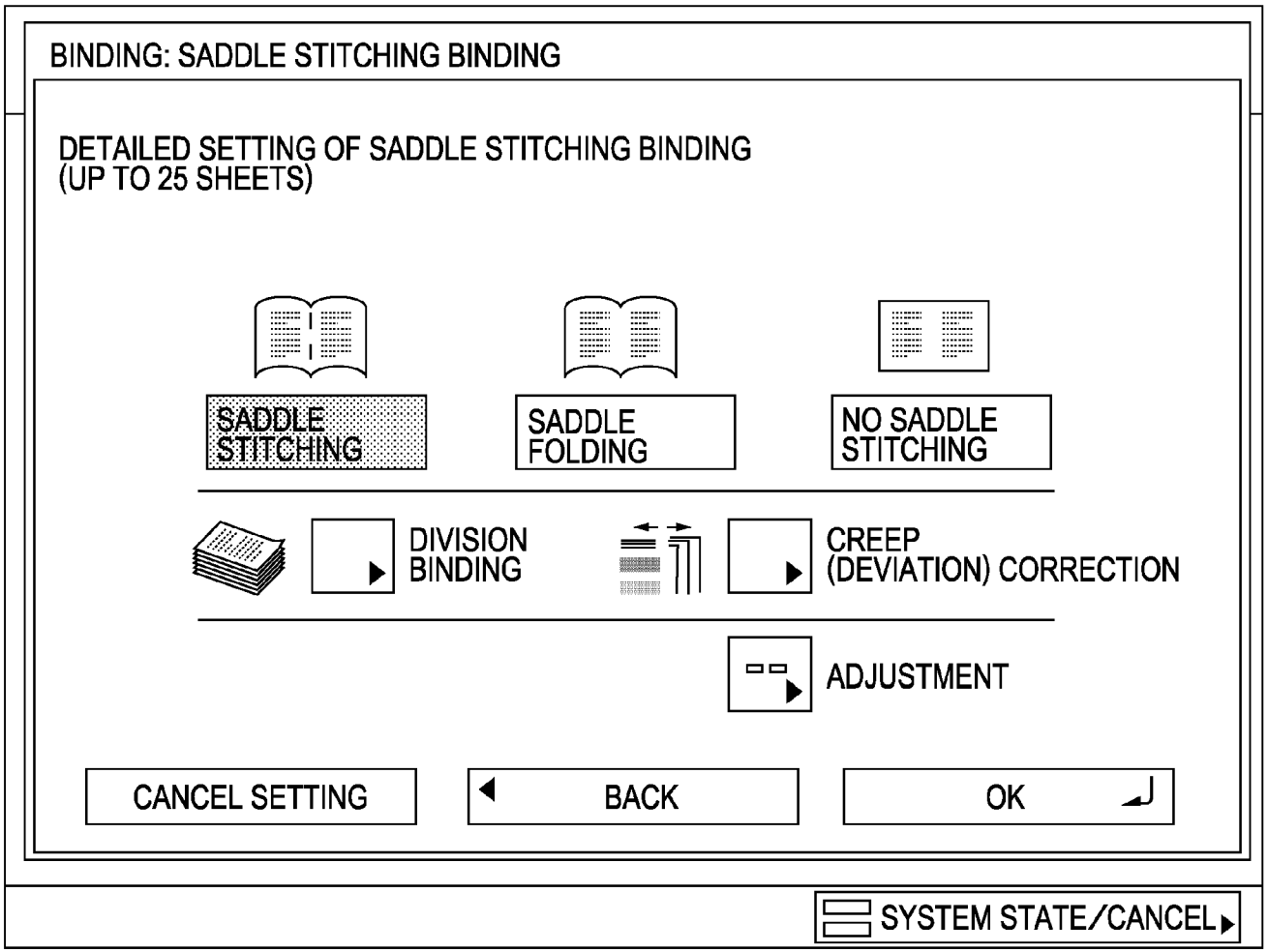
FIG. 15 is a diagram illustrating a screen displayed in a display unit according to the embodiment.

When an "OK" button of the screen shown in FIG. 14 is pressed, the screen shown in FIG. 15 is displayed. In the screen displayed in FIG. 15, a setting of finishing of a book is performed. Three types of finishing of book may be employed.

First type: Saddle stitching (the saddle-stitching binding process is executed)

Second type: Saddle folding (the center-folding binding process is executed)

Third type: Saddle stitching is not performed.

In the first type, sheets printed using the image forming apparatus 100 are conveyed to the finisher 315 and stored in the portion shown in FIG. 4 inside the finisher 315 using the stopper 44*a*. Then, a binding process is performed as follows; when a predetermined number of sheets which have been printed are stored, the centers of the sheets are bound using a stapler. Thereafter, the stopper 44*a* is moved to the position of the stopper 45*b* shown in FIG. 5. Then, the sheets which have been subjected to the binding process are further subjected to a folding process in which a bundle of the sheets are folded into two using the pushing plate 43 and the folding rollers 45 and 46, and are conveyed by the bundle conveying rollers 47 and 48 to be output to the sheet output tray 340.

In the second type, the sheets printed using the image forming apparatus 100 are supplied to the finisher 315 and stored in the position shown in FIG. 5 inside the finisher 315. When a predetermined number of sheets which have been printed are stored, the centers of the sheets are folded into two using the pushing plate 43 and the folding rollers 45 and 46, and the sheets are conveyed by the bundle conveying rollers 47 and 48 to be output to the sheet output tray 340. In this case, the binding process is not performed.

In the third type, although images of pages are arranged in accordance with the layout of bookbinding, neither the binding process nor the folding process is performed before output of the sheets. In this case, the sheets are not output to the sheet output tray 340 but the sheet output tray 328.

Figure 16:
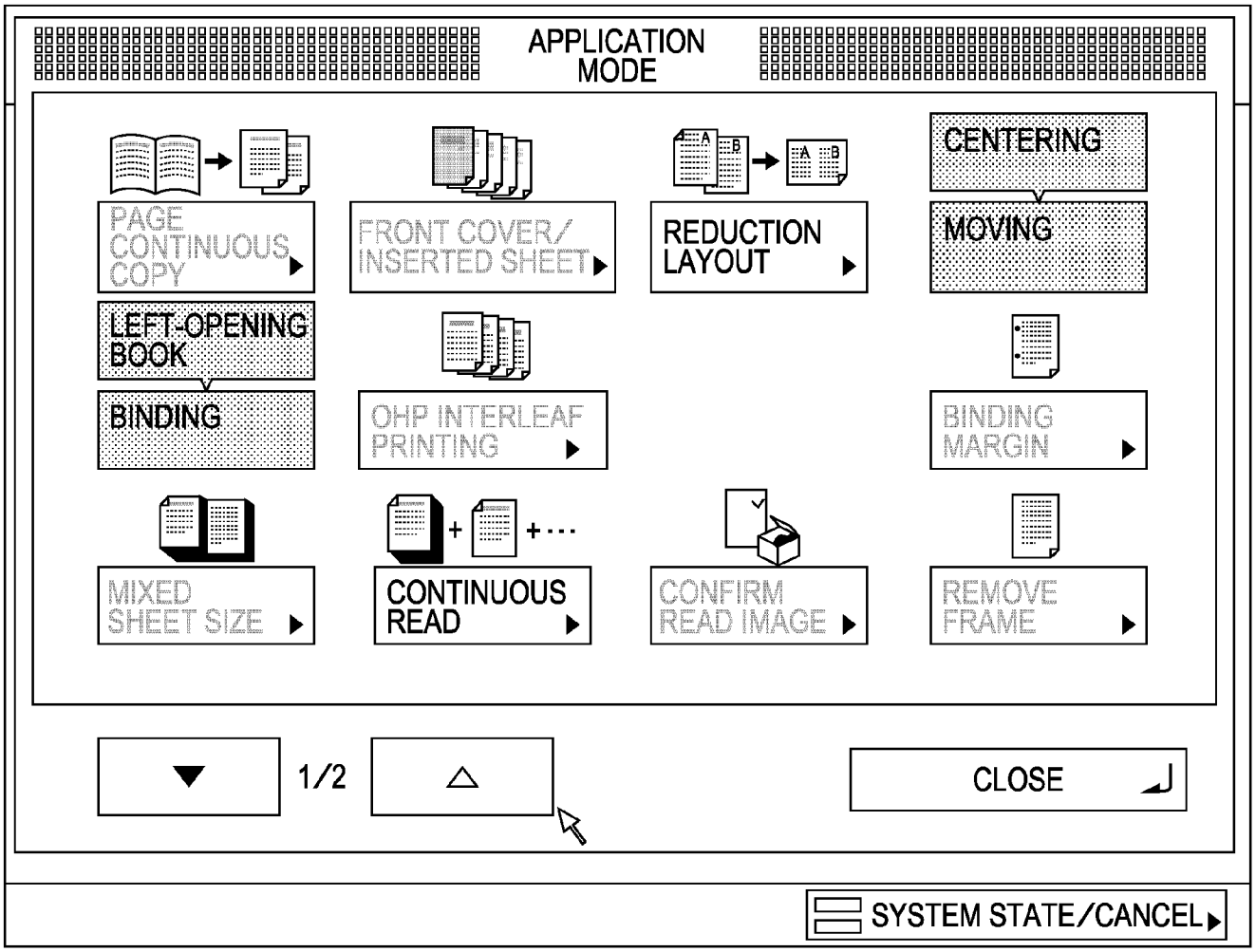
FIG. 16 is a diagram illustrating a screen displayed in a display unit according to the embodiment.

When an "OK" key is pressed after the setting of the finishing of a book is performed in the screen shown in FIG. 15, the screen shown in FIG. 16 is displayed. The CPU 402 stores the setting accepted through the screens shown in FIGS. 12 to 15 in the DRAM 406. When the CPU 402 displays the screen shown in FIG. 16, information representing that the setting of bookbinding has been performed is displayed in the screen. When a "close" key is pressed in the screen shown in FIG. 16, the CPU 402 displays the screen shown in FIG. 17.

Figure 17:
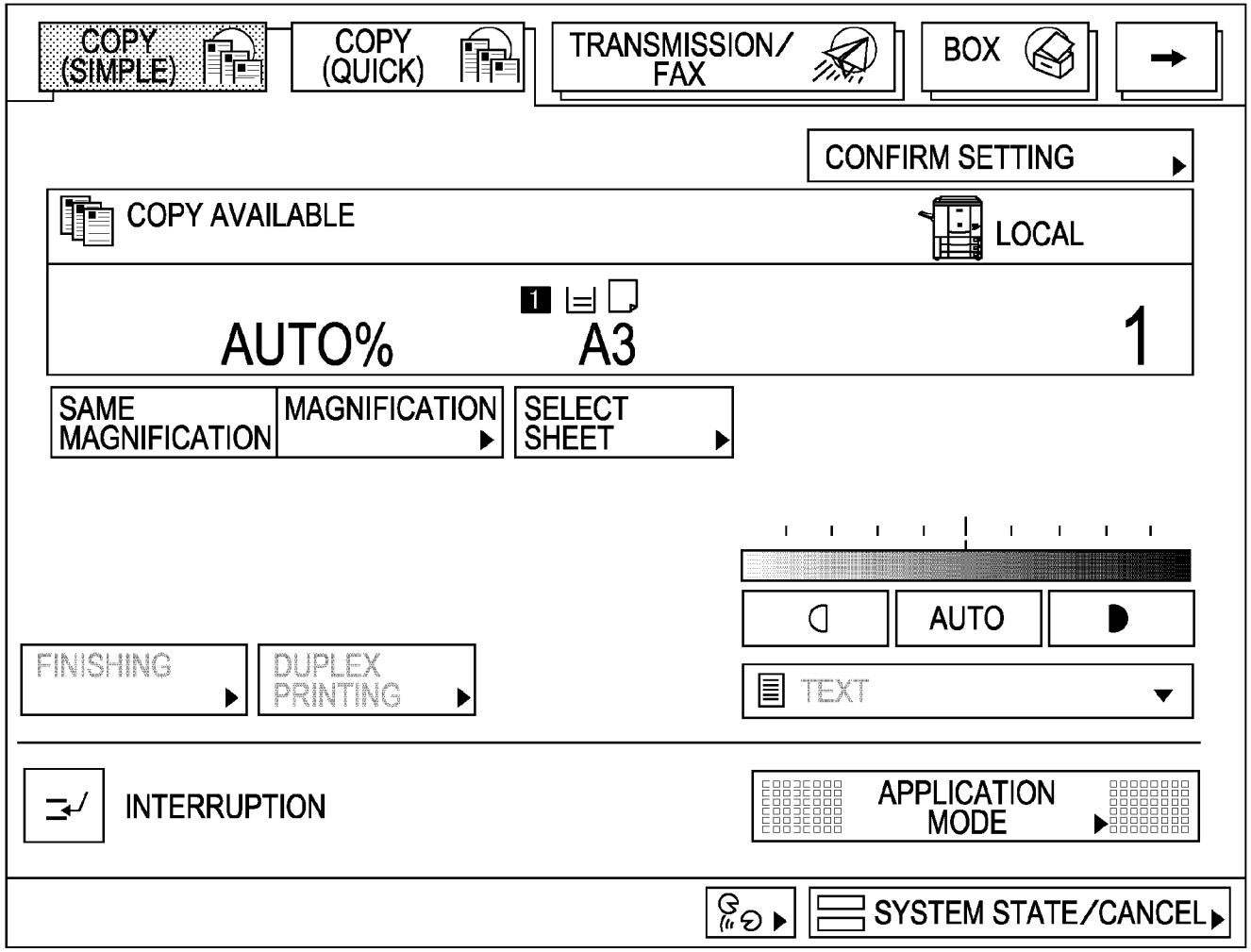
FIG. 17 is a diagram illustrating a screen displayed in a display unit according to the embodiment.

In a state in which the screen shown in FIG. 17 is displayed, when the start key 506 is pressed, the CPU 402 controls the scanner unit 201 to perform a process of reading the original documents and controls the printer unit 203 to perform a printing process in accordance with the setting stored in the DRAM 406.

By performing the processes described above, the user can obtain a book which has been subjected to the saddle-stitching binding process or the center-folding binding process.

However, the number of sheets which can be simultaneously processed has an upper limit depending on a capability of the finisher 315 (for example, a capability of binding sheets or a capability of folding sheets). For example, only 25 sheets can be simultaneously folded due to limitations of capabilities of the folding rollers 45 and 46. If the user instructs copy of 200 images of original documents, the image forming apparatus 100 outputs 50 sheets in total since images of two pages are arranged and printed on each of a front side and a back side per sheet. In addition, if the user performs the setting of the saddle-stitching binding process, the CPU 402 controls the finisher 315 to execute the saddle-stitching binding process in a unit of 25 sheets.

On the other hand, also when the setting of the center-folding binding process is performed, the number of sheets which can be simultaneously processed has an upper limit depending on the capability of the finisher 315 (a capability of folding sheets). In this case, according to the capabilities of the folding rollers 45 and 46, up to 25 sheets can be simultaneously folded. However, when the center-folding binding process is to be performed, the folded sheets are conveyed by the bundle conveying rollers 47 and 48 while the sheets are not bound. Therefore, the sheets which are being conveyed may be shifted from one another, and accordingly, jam may occur. To address this problem, in this embodiment, when the CPU 402 performs the center-folding binding process on the sheets and even when 25 sheets can be simultaneously folded taking the capability of the finisher 315 into consideration, the sheets are subjected to the center-folding binding process in a unit of five sheets and output. Accordingly, the sheets to be folded can be stably conveyed and a likelihood that the jam occurs can be reduced.

Furthermore, when the saddle-stitching binding process and the center-folding binding process are performed, a division binding function (separate binding function) may be employed. When the division binding function is used, a plurality of sheets to be output as a book are subjected to the saddle-stitching binding process or the center-folding binding process in a unit of the predetermined number of sheets and are output as a book by separate binding. The number of sheets may correspond to a value set in advance in the sheet processing apparatus or may be set by the user. In this embodiment, a case where the user sets the number of sheets will be described as an example. Note that, layout of pages in a case where the division binding function is used and layout of pages in a case where the division binding function is not used are different from each other, and the pages are arranged as shown in FIG. 21 or 22.

Figure 18:
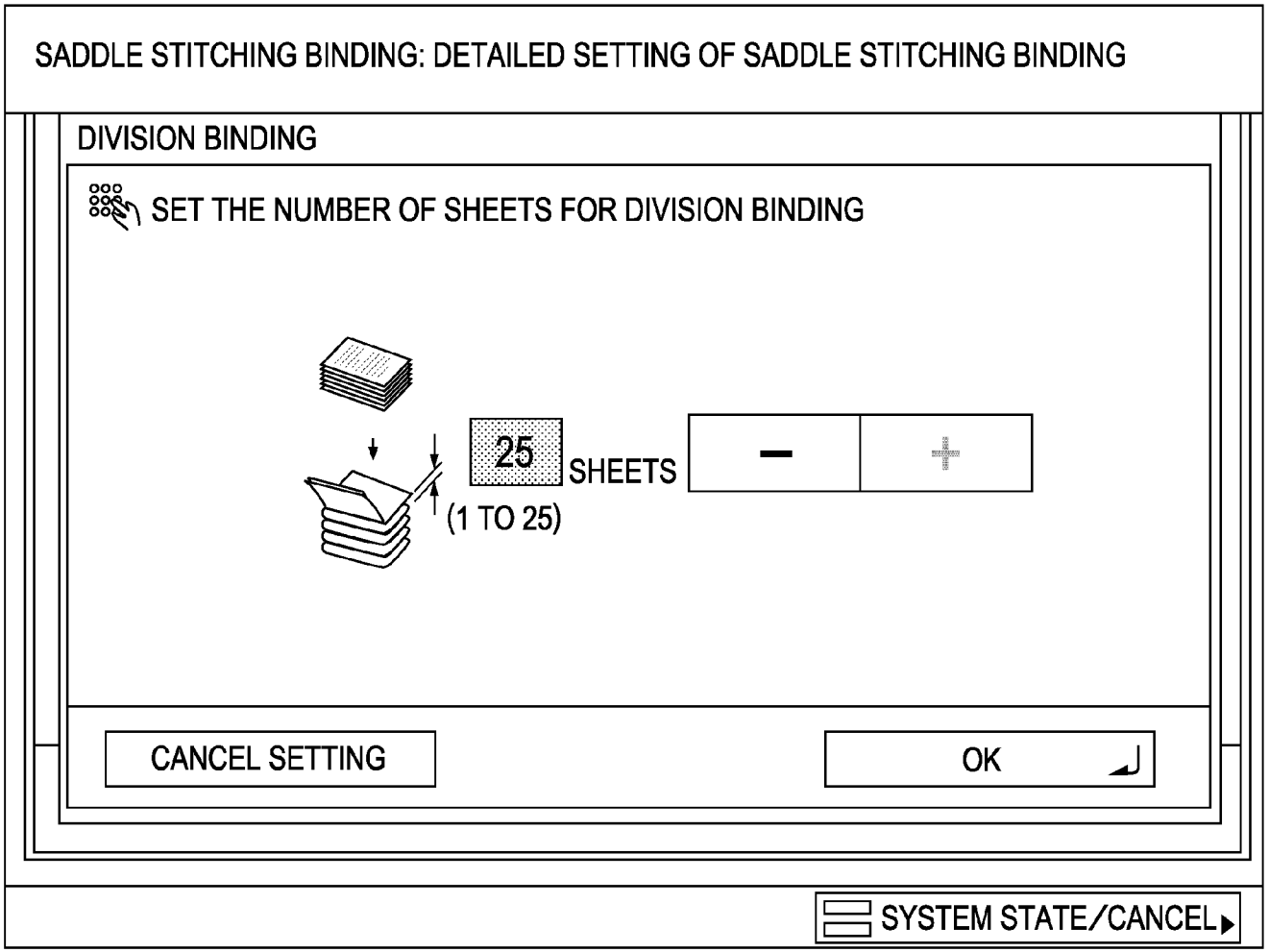
FIG. 18 is a diagram illustrating a screen displayed in a display unit according to the embodiment.

If the user presses a "division binding" button included in the screen of FIG. 15 when the setting of the bookbinding process is performed as shown in FIGS. 11 to 16, the division binding function can be used. For example, when a "saddle stitching" button is selected to perform the saddle-stitching binding process and further the "division binding" button is pressed, the screen shown in FIG. 18 is displayed. The user can perform a setting which specifies the number of sheets included in a bundle to be output. The CPU 402 accepts the setting of the number of sheets within a range from 1 to 25 which is an upper limit value for the saddle-stitching binding process. Note that when the division binding is selected, the pages of the original documents are output after the pages are arranged in an appropriate order by overlapping output objects which have been subjected to the division binding so as to be adjacent to one another.

Layout of the pages and a result of output in a case where the division binding function is used and layout of the pages and a result of output in a case where the division binding function is not used will be described in detail with reference to FIGS. 21 and 22.

Figure 21:
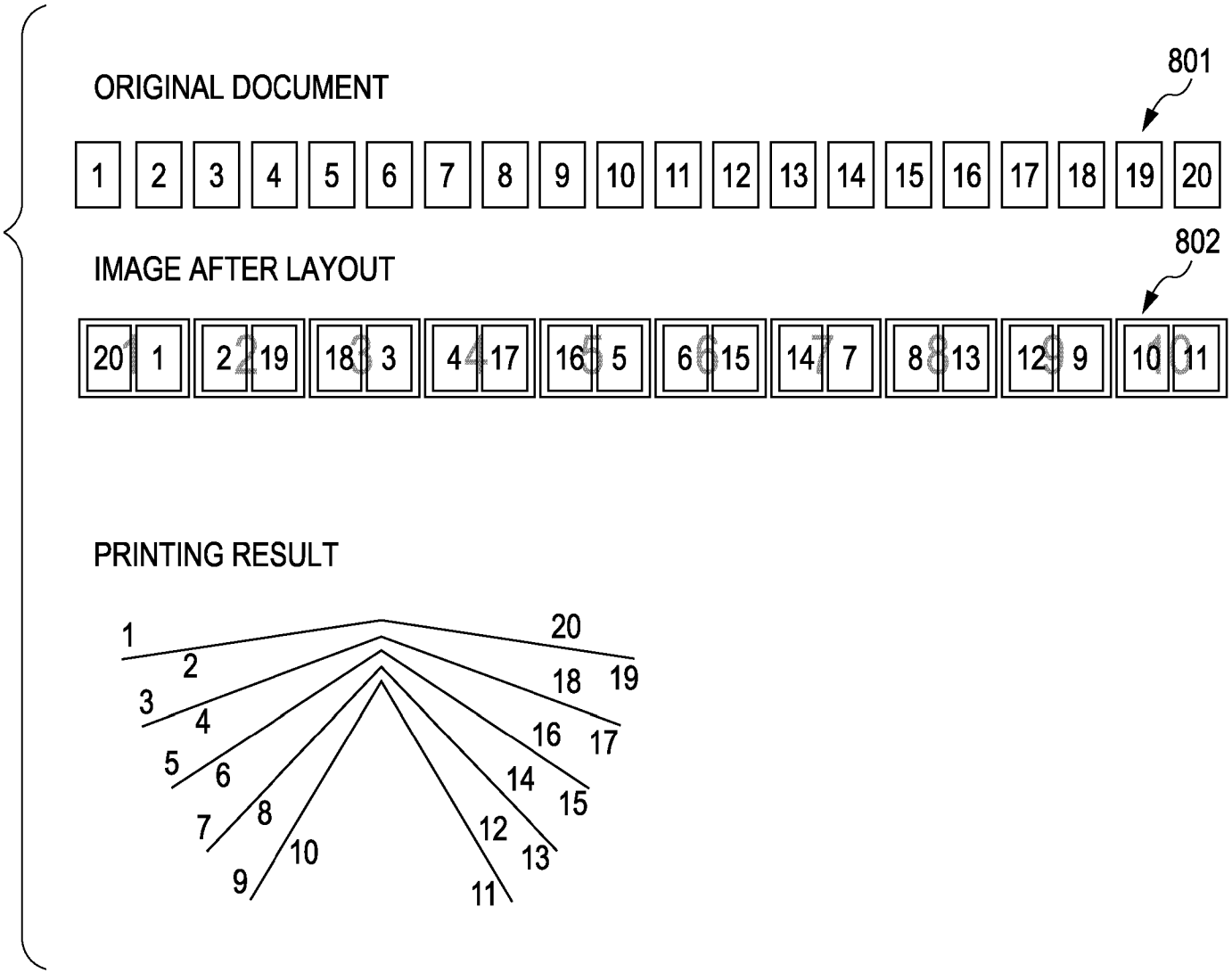
FIG. 21 is a diagram illustrating a layout method according to the embodiment.
Figure 22:
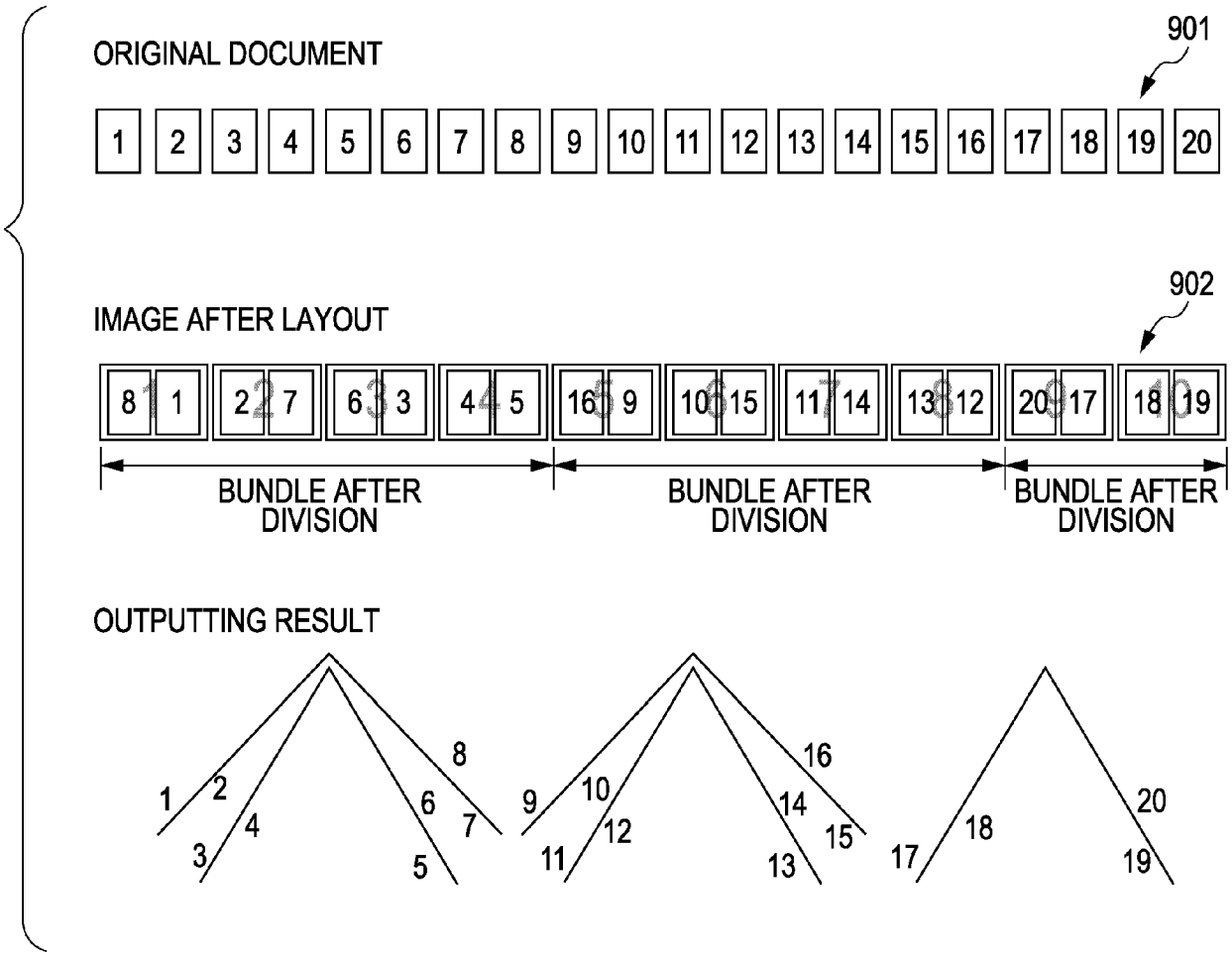
FIG. 22 is a diagram illustrating another layout method according to the embodiment.

FIG. 21 is a diagram illustrating a layout method of the pages of images of original documents when the saddle-stitching binding process is performed. When the saddle-stitching binding process is executed, the images in the pages of the original documents indicated by a reference numeral 801 are arranged as layout 802 and stored in the DRAM 406. After the images are arranged, the images are printed starting from an image of an innermost sheet of all sheets to be folded. In a case where the images are arranged as shown in FIG. 21, the CPU 402 first prints a region 9 (on a front side of a first sheet), a region 10 (on a back side of the first sheet), a region 7 (on a front side of a second sheet), and a region 8 (on a back side of the second sheet). Then, the CPU 402 prints a region 5 (on a front side of a third sheet), a region 6 (on a back side of the third sheet), a region 3 (on a front side of a fourth sheet), a region 4 (on a back side of the fourth sheet), a region 1 (on a front side of a fifth sheet), and a region 2 (on a back side of the fifth sheet) in this order. Note that the reference numerals described above corresponds to large numbers shown in the layout 802. After the printed sheets are switched back, the sheets are sequentially stored in the conveying-path 41. Then, the sheets are subjected to the binding process and the folding process, and then, are output to the sheet output tray 340. A result of the output of the sheets is shown in FIG. 21. When the division binding has not been set and 25 sheets or less are required for printing the stored images, the CPU 402 executes the binding process and the folding process in accordance with the layout method shown in FIG. 21 and outputs the sheets. In this case, the user can obtain a book without overlapping a result of printing with another output object. On the other hand, when the division binding has not been set and 26 sheets or more are required for printing the stored images, the CPU 402 performs neither the binding process nor the folding process on the sheets and outputs the sheets to the sheet output tray 328. In this case, the user uses a dedicated binding apparatus which is referred to as an "off-line finisher" and which performs the binding process and the folding process on sheets to obtain a book. Alternatively, when the division binding has not been set and 26 sheets or more are required for printing the stored images, the folding process may be performed in a unit of 25 sheets before the sheets are output without performing the binding process.

On the other hand, when the saddle-stitching binding process has been set and the division binding is set by pressing the "division binding" button so that the sheets are divided in a unit of two sheets, the CPU 402 arranges the images of pages of the original documents indicated by a reference numeral 901 as layout 902 shown in FIG. 22. In this case, the CPU 402 instructs performance of printing on a region 4 (on a front side of a first sheet), a region 3 (on a back side of the first sheet), a region 1 (a front side of a second sheet), a region 2 (on a back side of the second sheet) in this order. Note that the numbers described above corresponds to large numbers shown in the layout 902. After the printed sheets are switched back in the center tray 323, the sheets are sequentially stored in the conveying-path 41. Then, the sheets are subjected to the binding process and the folding process, and then, are output to the sheet output tray 340.

Similarly, the CPU 402 prints the following pages, that is, a region 7 (on a front side of a first sheet), a region 8 (on a back side of the first sheet), a region 5 (on a front side of a second sheet), and a region 6 (on a back side of the second sheet), in this order. After the printed sheets are switched back in the center tray 323, the sheets are sequentially stored in the conveying-path 41. Then, the sheets are subjected to the binding process and the folding process, and then, are output to the sheet output tray 340.

Finally, the CPU 402 prints a region 9 (on a front side of a first sheet) and a region 10 (on a back side of the first sheet). Then, the sheets are switched back in the center tray 323, supplied to the conveying-path 41, subjected to the folding process, and output to the sheet output tray 340. Since this sheet corresponds to the last sheet, the CPU 402 does not to perform the binding process. A result of output of the sheets is shown in FIG. 22. When the division binding is performed, sheet bundles overlap with one another such that a last page of a first bundle overlaps with a first page of a second bundle. In this way, the sheets are arranged in an appropriate order of pages. The second bundle and a third bundle are similarly arranged in an appropriate order of pages by overlapping a last page of the second bundle with a first page of the third bundle. The user can obtain a book in which the pages of the images of the original documents are printed in an appropriate order by combining the first to third sheets bundles.

Figure 19:
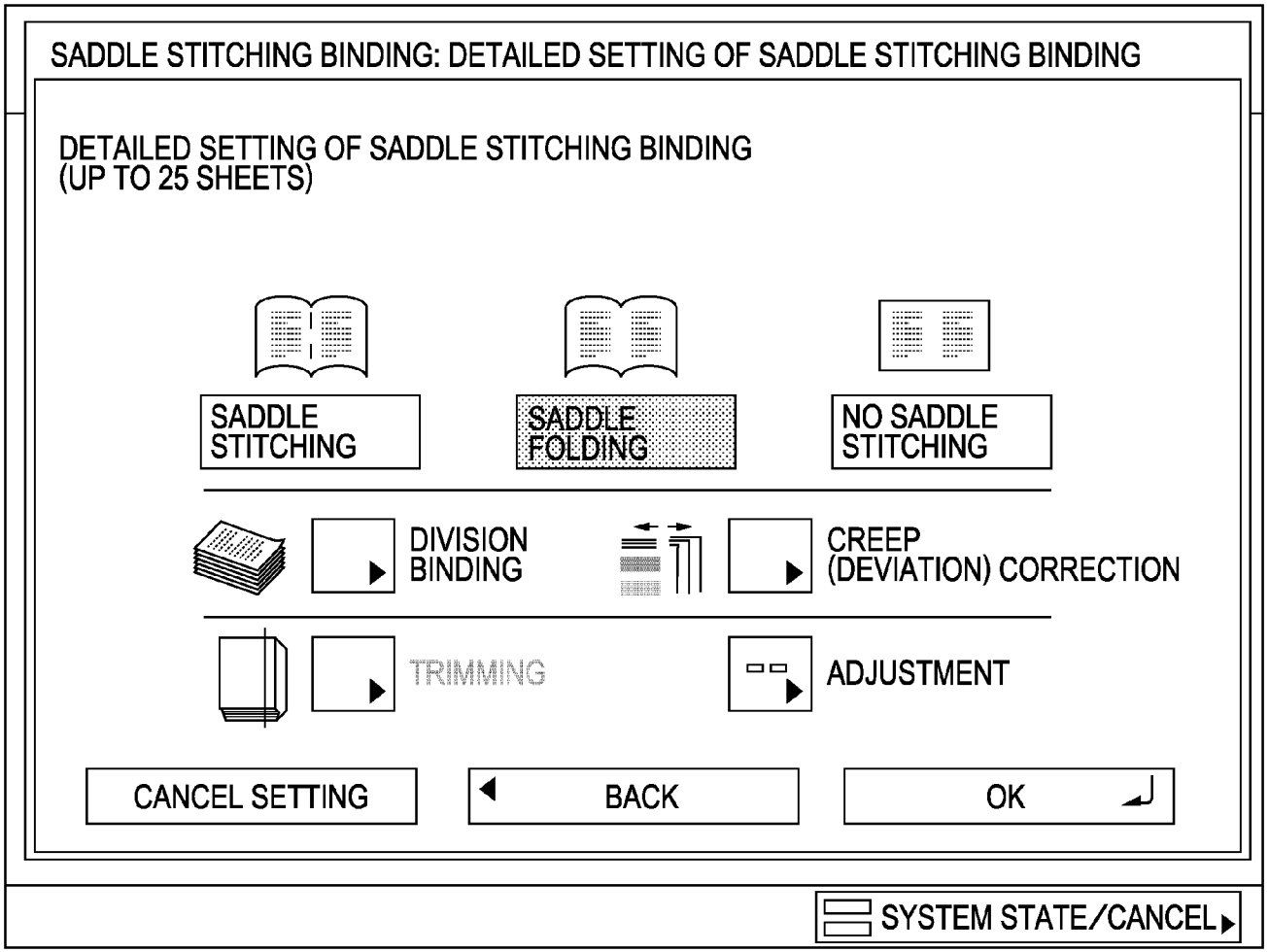
FIG. 19 is a diagram illustrating a screen displayed in a display unit according to the embodiment.

On the other hand, when the center-folding binding process in which the binding process is not performed but only the folding process is performed is executed, the user selects a "saddle folding" button shown in FIG. 19.

Figure 24:
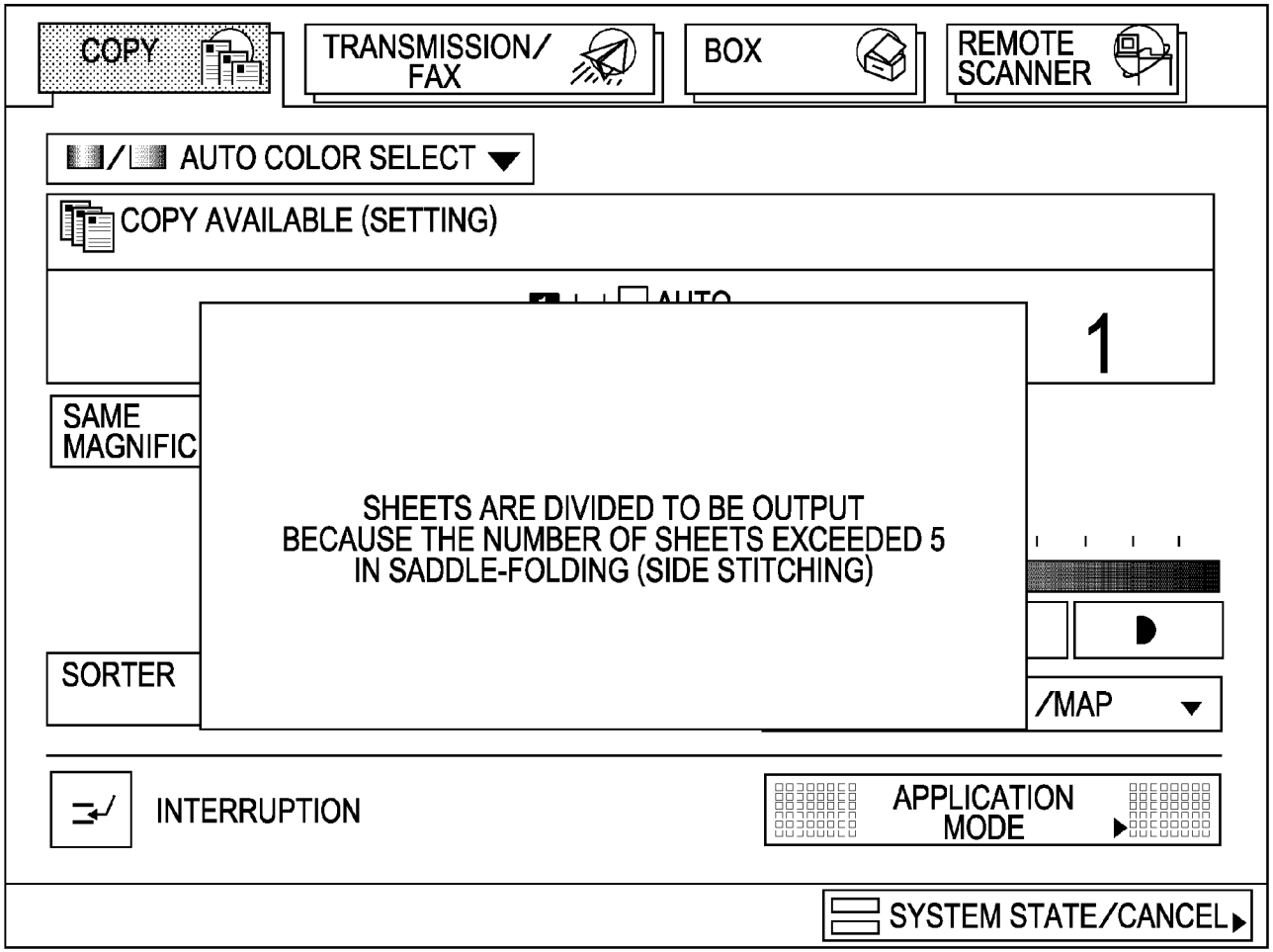
FIG. 24 is a diagram illustrating a screen displayed in the display unit according to the embodiment.

When the center-folding binding process is executed before the sheets are output, an output result shown in FIG. 23 is obtained. When the center-folding binding process is executed before the sheets are output, only 5 sheets can be simultaneously folded. Accordingly, the relationship between the number of sheets included in a bundle and an output result is as shown in FIG. 23. When the number of sheets included in a bundle exceeds 5, the user can obtain a book by combining sheet bundles such that a sheet bundle which is first output is inserted into the center of a sheet bundle which is subsequently output. Note that even if a setting for separately outputting sheet bundles has not been performed by the user, the CPU 402 separately outputs the sheet bundles in an automatic manner. Therefore, the user may not know that the sheet bundles are separately output. Accordingly, when separate sheet bundles are output as the output result, information representing that the sheet bundles are separately output may be displayed as a screen in the display unit 505 as shown in FIG. 24. In this case, the CPU 402 may notify the user of a combination of the sheet bundles by displaying a drawing as shown in a case of 20 sheets in FIG. 23. By this, the user can easily obtain information representing that the sheet bundles are separately output and information on a combination of the sheet bundles which have been separately output.

Furthermore, when the center-folding binding process is performed, the user can utilize the division binding function. In this case, the CPU 402 displays the images of the original documents as the layout 902 shown in FIG. 22. Then, the CPU 402 performs printing in a printing order similar to the printing in the case of the saddle-stitching binding process, and the folding process is performed while the binding process is not performed, and thereafter, outputs the sheets. A printing result in this case is shown in FIG. 22. The user can obtain a book including successive pages by overlapping sheet bundles which have been separately bound with one another.

As described above, according to this embodiment, in a case where the center-folding binding process is performed, when the number of sheets required for printing exceeds 5, the sheets are separately bound irrespective of whether the division binding function is used.

In this case, the user may intend to select a combination of output sheet bundles (booklets) to be a book. For example, the user may intend to obtain a book generated by a method for combining sheet bundles such that a sheet bundle which is output first is inserted into the center of a sheet bundle which is subsequently output as shown in FIG. 23. Alternatively, the user may intend to obtain a book generated by overlapping output sheet bundles with one another.

In this embodiment, when the division binding function is not used, a book can be obtained by a method for combining sheet bundles such that a sheet bundle which is output first is inserted into the center of a sheet bundle which is subsequently output. Alternatively, when the division binding function is not used, a book can be obtained by a method for overlapping output sheet bundles with one another.

As described above, when the division binding function is used, the finisher 315 can perform the saddle-stitching binding process on up to 25 sheets. However, if it is set that an upper limit of the number of sheets included in a sheet bundle obtained through the division binding function is 25 also when the center-folding binding process is performed, the following problem occurs. Specifically, an undesired book may be generated.

If the user performs a setting for dividing the sheets into bundles each of which includes 25 sheets to be output, and the bundles of sheets are successively subjected to the center-folding binding process, the folded sheets are shifted from one another and therefore jam may occur due to conveying capabilities of the bundle conveying rollers 47 and 48. Furthermore, if the CPU 402 divides the sheets into bundles each of which includes 5 sheets to be output, a desired output result is not obtained.

Figure 25:
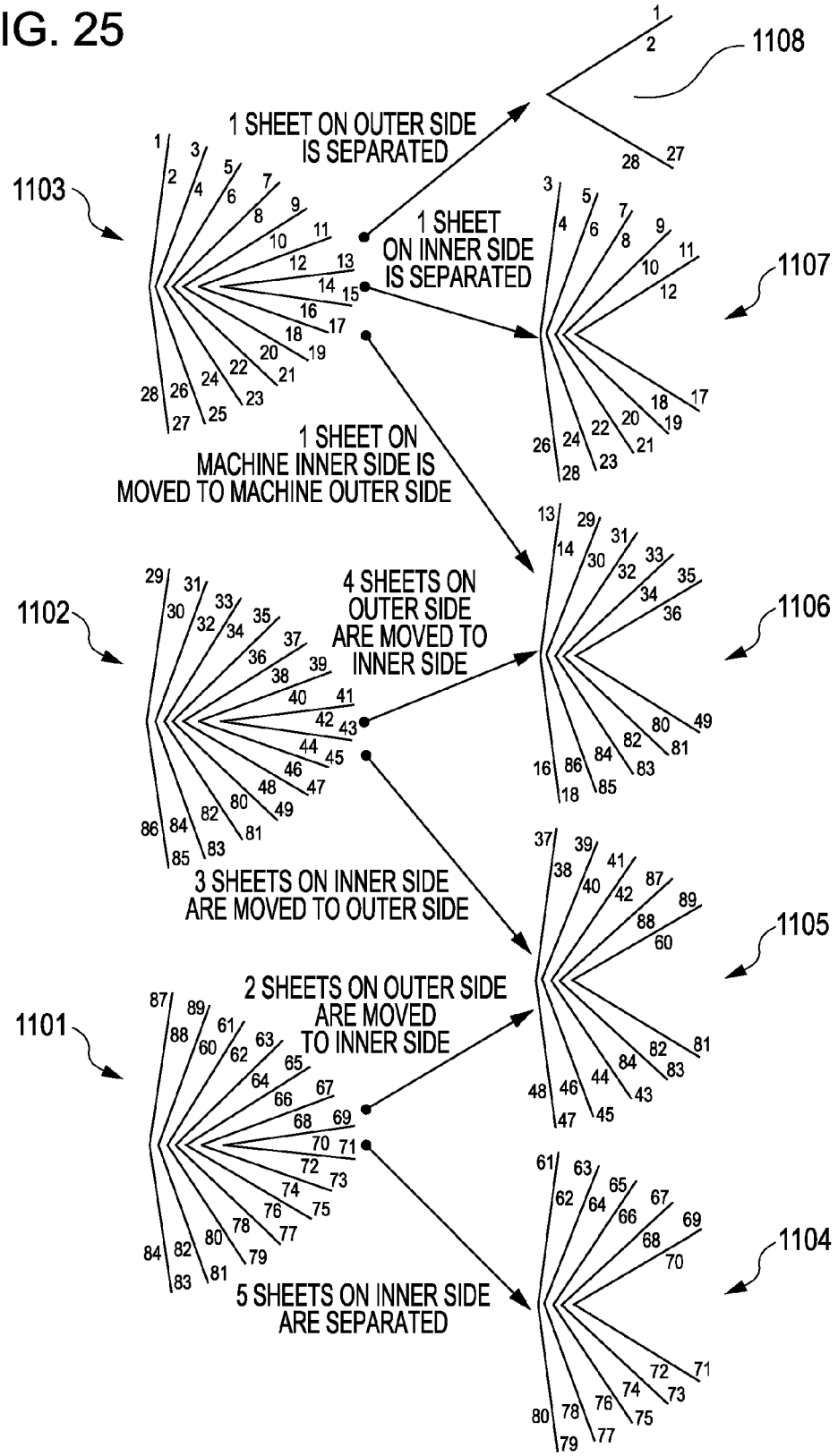
FIG. 25 is a diagram illustrating a further layout method according to the embodiment.

The reason that a desired output result is not obtained will be described with reference to FIG. 25. In FIG. 25, drawings on the left in FIG. 25 are bundles obtained after the saddle-stitching binding process is performed when the user performs a setting of division binding in the screen shown in FIG. 18 so that sheets are to be divided into the bundles each of which includes seven sheets.

In this case, the sheet bundles 1101, 1102, and 1103 are output from the apparatus in this order starting from the sheet bundle 1101 on a lower left of FIG. 25. When the saddle-stitching binding process is performed, up to 25 sheets can be normally output. Accordingly, when the sheets are divided into bundles each of which includes seven sheets to be bound, the sheets are uneventfully output. The user can obtain a book including pages arranged in an appropriate order since the output sheet bundles overlap with one another.

However, when the user sets the center-folding binding process and the division binding is to be performed on the bundles each of which includes seven sheets, the main controller 401 arranges the pages similarly to the case of the saddle-stitching binding process as shown on the left side of FIG. 25. Then, the CPU 402 folds and outputs the sheets divided into groups each of which includes five sheets so that the sheets are stably conveyed. Therefore, sheet bundles as shown on a right side of FIG. 25 are obtained as output sheet bundles.

In this case, pages of a sheet bundle stored in the finisher 315, for example, are arranged as the sheet bundle 1101, and five sheets from the innermost sheets are output to the sheet output tray 340. As a result, the sheets are output as a bundle 1104. Then, as a next bundle, remaining two sheets (on an outer side) of the bundle 1101 are combined with three sheets on an inner side of the next bundle 1102 so that a bundle 1105 including the five sheets is output. Similarly, remaining four sheets on an outer side of the bundle 1102 are combined with one sheet on an inner side of the bundle 1103 so that a bundle 1106 including the five sheets is output. Five sheets in the middle of the bundle 1103 are included in a bundle 1107, and a remaining one sheet of the bundle 1103 is finally output.

As a result, when the user overlaps the output bundles which have been subjected to the division binding such that the bundles 1104 to 1108 are arranged so as to adjacent to one another, an irregular order of pages occurs such as an order of a 1st page, a 2nd page, a 27th page, a 28th page, a 3rd page, a 4th page, . . . 11th page, 12th page, 17th page, 18th page, . . . 25th page, 26th page, 13th page, 14th page and so on. In this case, the user should unbind the sheet bundles once to attain an appropriate order of the pages of the output objects. As a result, considerably large labor is required.

Figure 20:
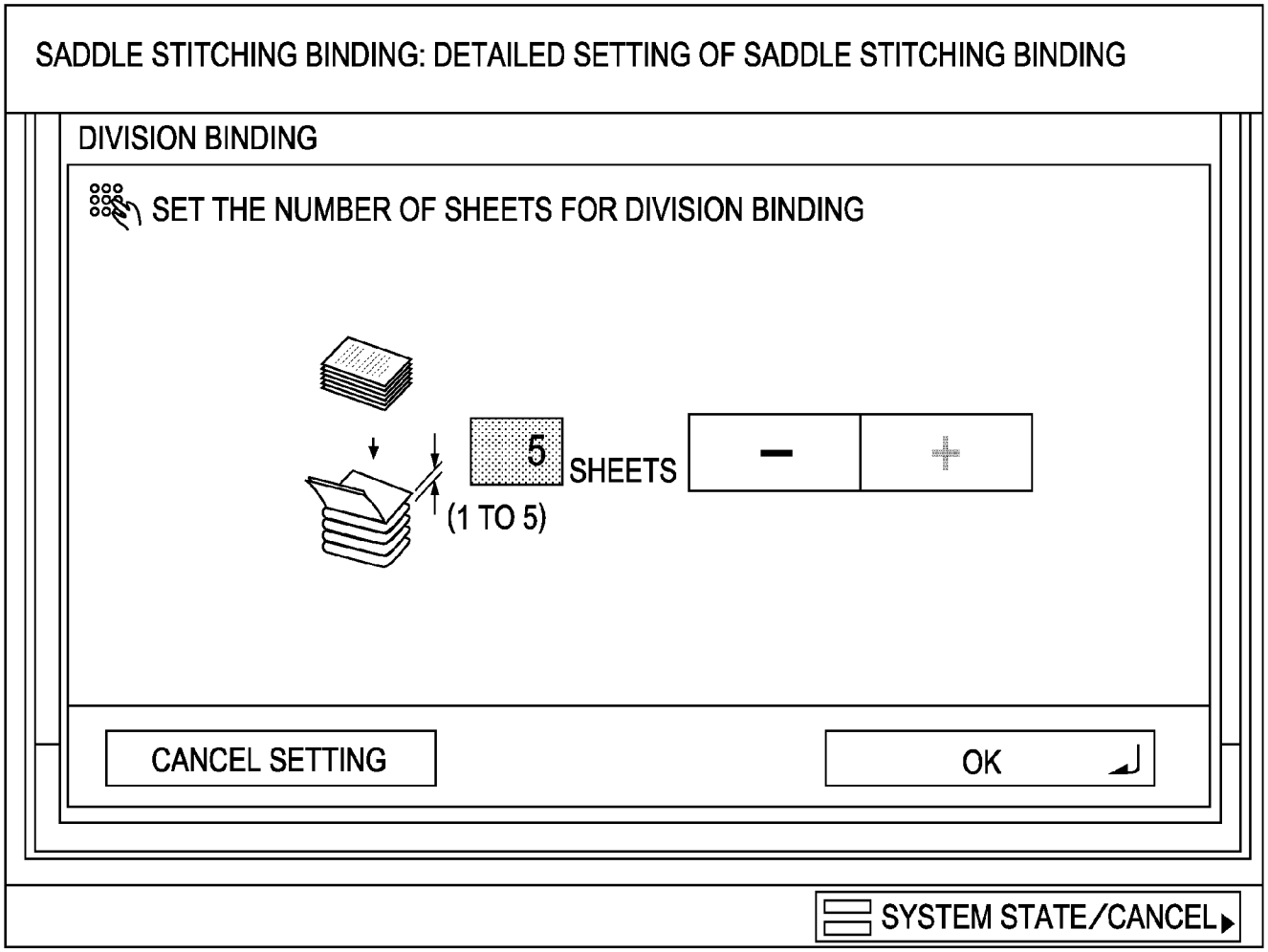
FIG. 20 is a diagram illustrating a screen displayed in a display unit according to the embodiment.

Therefore, in this embodiment, when the division binding is performed after the center-folding binding process is performed without binding the sheets, the CPU 402 limits the number of acceptable sheets through the screen shown in FIG. 20 to one to five. By this, the user can obtain an appropriate output result.

Next, a procedure of a control process performed by the CPU 402 of this embodiment will be described with reference to FIG. 26. The CPU 402 executes steps shown in a flowchart of FIG. 26 by executing a program stored in the ROM 404.

Figure 26:
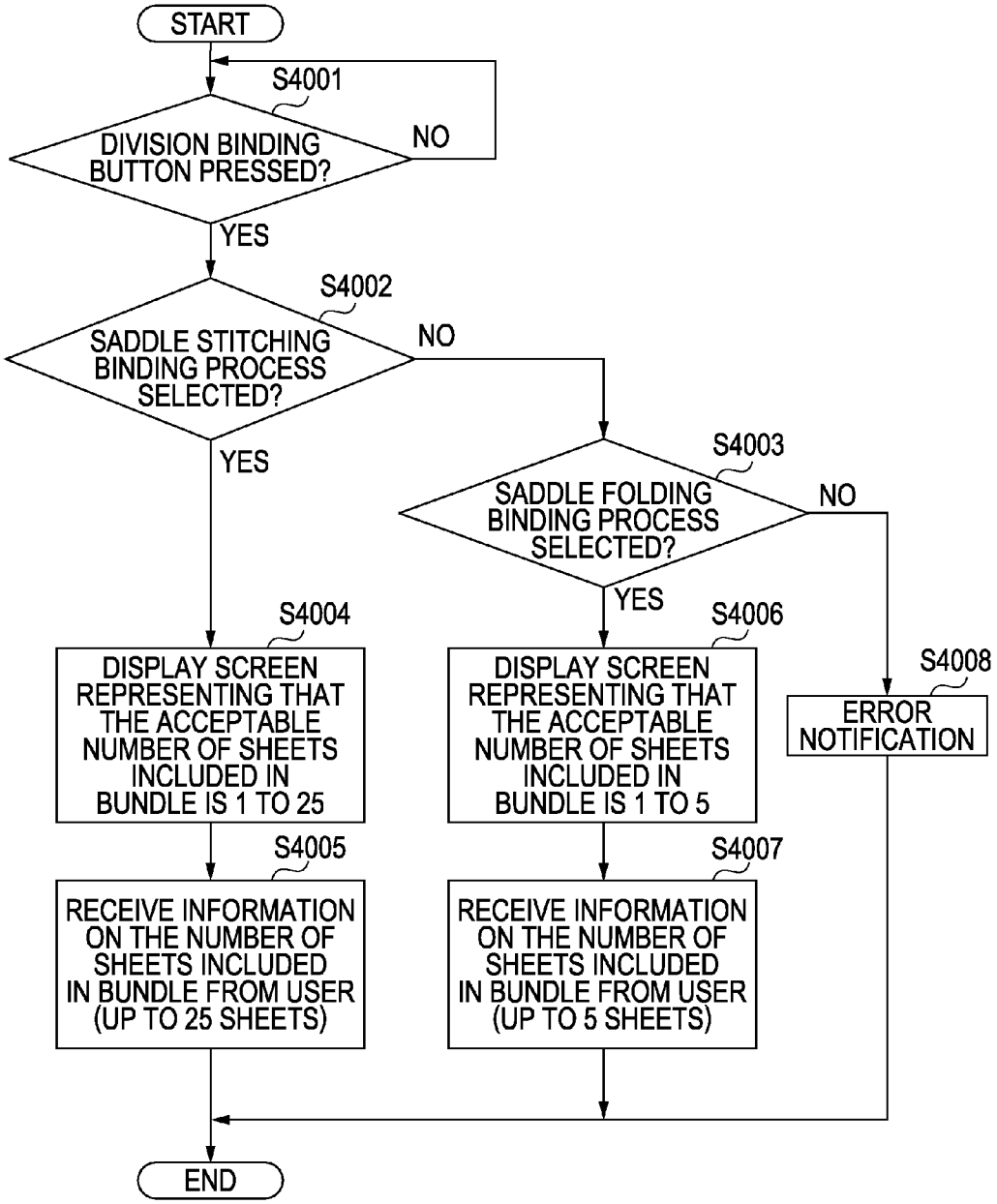
FIG. 26 is a flowchart according to the embodiment.

The flowchart shown in FIG. 26 illustrates the control process performed by the CPU 402 when the "division binding" button in the screen shown in FIG. 15 is pressed.

First, the CPU 402 determines whether the "division binding" button is pressed in step S4001. When the determination is negative in step S4001, the process of step S4001 is repeatedly performed, whereas when the determination is affirmative in step S4001, the CPU 402 proceeds to step S4002.

In step S4002, the CPU 402 determines whether the "saddle stitching" button in the screen shown in FIG. 15 has been pressed so that the saddle-stitching binding process is selected. When the determination is affirmative in step S4002, the CPU 402 proceeds to step S4004 whereas when the determination is negative in step S4002, the CPU 402 proceeds to step S4003.

In step S4004, the CPU 402 instructs the display unit 505 to display the screen shown in FIG. 18 which indicates that the number of acceptable sheets per a sheet bundle which is obtained by dividing all the sheets is 1 to 25.

Then, in step S4005, the CPU 402 receives a setting of the number of sheets input by the user. In this case, the CPU 402 accepts the setting of the number of sheets using the numeric keypad 504 or a "+/−" key shown in FIG. 18. When the number of sheets except for 1 to 25 is specified, the CPU 402 restricts the specified number of sheets. A method for the restriction includes a method for disabling input of a number other than 1 to 25 by setting 25 which is an upper limit value when 28, for example, is input using the numeric keypad 504. Furthermore, when a number larger than 25 is input using the "+/−" key, the number larger than 25 may be determined as an invalid number and 25 may be set. Similarly, as for an lower limit value, that is, 1 in this embodiment, when 0 is input using the numeric keypad 504 or the "+/−" key, the CPU 402 may determine that the input number is invalid. Furthermore, when the number of sheets which can be set is restricted by the method described above, a message which notifies the user of the restriction may be displayed.

Figure 27:
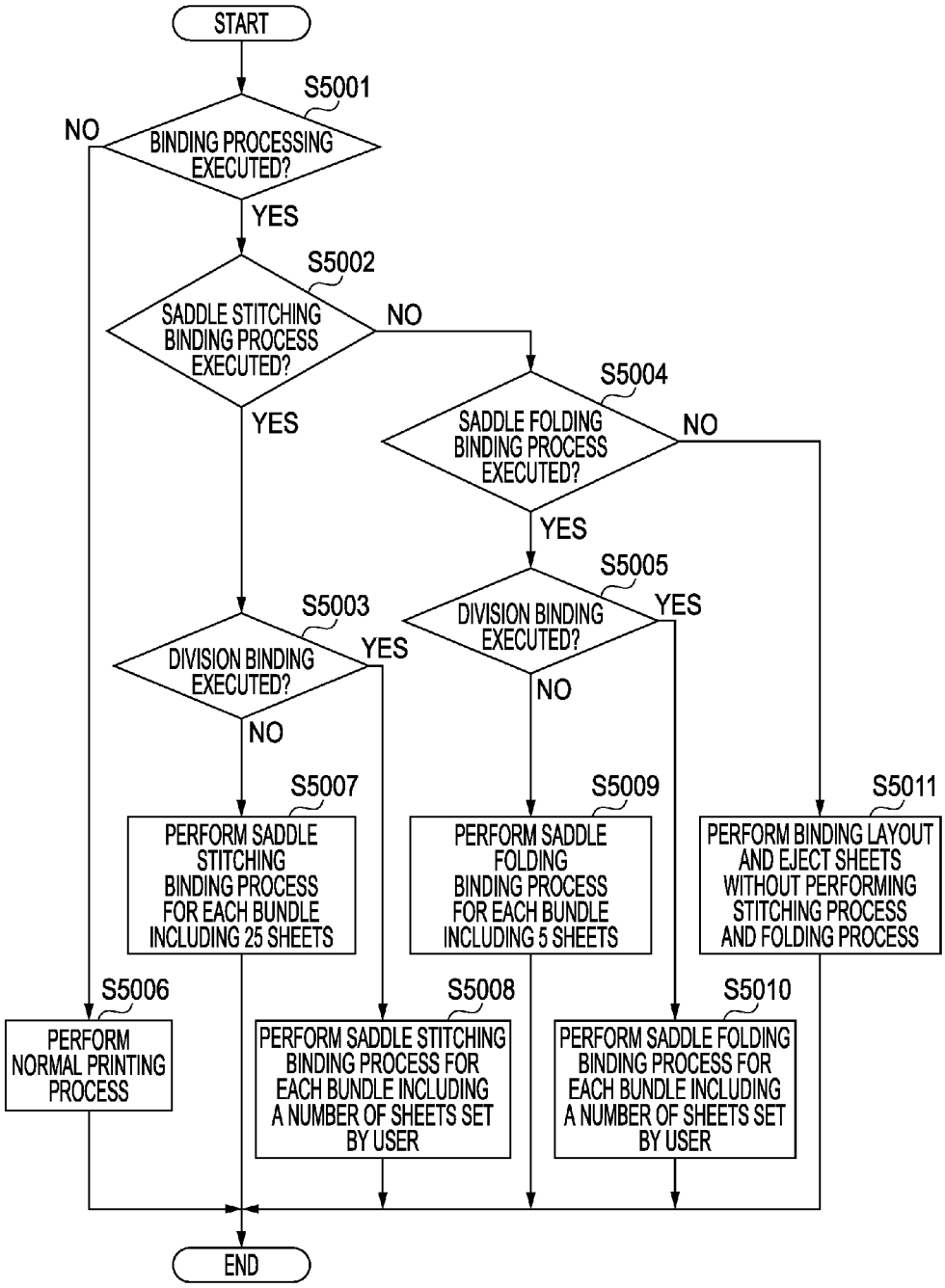
FIG. 27 is another flowchart according to the embodiment.

After the number of sheets among 1 to 25 is input and an "OK" key is pressed, the number of sheets which is accepted is stored in the DRAM 406. Then, the process is terminated. Thereafter, when the binding process which will be described hereinafter with reference to FIG. 27 is to be performed, the CPU 402 performs the binding process in accordance with the value stored in the DRAM 406.

On the other hand, when proceeding to step S4003, the CPU 402 determines whether the "saddle folding" button shown in FIG. 15 has been pressed so that the center-folding binding process is selected. When the determination is affirmative in step S4003, the CPU 402 proceeds to step S4006 whereas when the determination is negative in step S4003, the CPU 402 proceeds to step S4008.

When proceeding to step S4006, the CPU 402 instructs the display unit 505 to display the screen shown in FIG. 20 representing that the number of acceptable sheets which can be included in a single divided bundle is 1 to 5.

Then, in step S4007, the CPU 402 accepts a setting of the number of sheets input by the user. In this case, the CPU 402 accepts the setting of the number of sheets input using the numeric keypad 504 or the "+/−" key shown in FIG. 18. When the number of sheets except for 1 to 5 is specified, the CPU 402 restricts the specified number of sheets. A method for the restriction includes a method for disabling input of a number other than 1 to 5 by setting 5 which is an upper limit value even when 7, for example, is input using the numeric keypad 504. Furthermore, when a number larger than 5 is input using the "+/−" key, the number larger than 5 may be determined as an invalid number and 5 may be set. Similarly, as for an lower limit value, that is, 1 in this embodiment, when 0 is input using the numeric keypad 504 or the "+/−" key, the CPU 402 may determine that the input number is invalid. Furthermore, when the number of sheets which can be set is restricted by the method described above, a message which notifies the user of the restriction may be displayed.

After the number of sheets selected from among 1 to 5 is input and the "OK" key is pressed, the number of sheets which is accepted is stored in the DRAM 406. Then, the process is terminated. Thereafter, when the binding process which will be described hereinafter with reference to FIG. 27 is to be performed, the CPU 402 performs the binding process in accordance with the value stored in the DRAM 406.

When proceeding to step S4008, the CPU 402 performs error notification. A case where the CPU 402 proceeds to step S4008 corresponds to a state in which neither the "saddle stitching" button nor the "saddle folding" button is selected. In addition, a state in which a "no saddle stitching" button is selected is also included. In this case, since the sheets are not folded, the setting of the division binding is not required. Furthermore, when neither the "saddle stitching" button nor the "saddle folding" button is selected, the CPU 402 may gray out the "division binding" button so as not to be selectable in stead of the method for displaying an error message.

Next, a procedure of another control process performed by the CPU 402 of this embodiment will be described with reference to FIG. 27. The CPU 402 executes steps shown in a flowchart of FIG. 27 by executing a program stored in the ROM 404.

When receiving a request for executing a job which is issued when the start key 506 is pressed, the CPU 402 starts processing shown in the flowchart of FIG. 27. For example, when receiving a request for executing a copy job in which images of original documents read by the scanner unit 201 are to be printed by the printer unit 203, the CPU 402 arranges the images of the original documents and prints them, and further performs the processing shown in the flowchart on printed sheets. Furthermore, when receiving a request for executing a print job in which images transmitted from an external PC are to be printed using the printer unit 203, the CPU 402 arranges the images transmitted from the PC and prints them, and further performs the processing shown in the flowchart on printed sheets.

The CPU 402 determines whether the binding process has been set in step S5001. When the determination is affirmative, the CPU 402 proceeds to step S5002 whereas when the determination is negative, the CPU 402 proceeds to step S5006.

When proceeding to step S5006, the CPU 402 executes a process in accordance with a setting performed by the user which is different from a setting of the binding process. For example, sheets are output after printing performed by the image forming apparatus 100 while post-processing is not performed by the finisher 315.

When proceeding to step S5002, the CPU 402 determines whether the saddle-stitching binding process is set. When the determination is affirmative, the CPU 402 proceeds to step S5003 whereas when the determination is negative, the CPU 402 proceeds to step S5004.

In step S5003, the CPU 402 determines whether the "division binding" button has been pressed so that the division binding is executed.

When the determination is negative in step S5003, the CPU 402 proceeds to step S5007. In step S5007, the CPU 402 performs layout of pages in the method shown in FIG. 21. Then, the CPU 402 performs the binding process in a unit of 25 sheets at a position of the stopper 44*a*, folds the sheets at a position of the stopper 44*b*, and outputs the sheets.

On the other hand, when the division binding function is set, the CPU 402 proceeds to step S5008. In step S5008, the CPU 402 performs layout of pages in the method shown in FIG. 22. Then, the CPU 402 executes the binding process in a unit of the predetermined number of sheets set by the user in step S4005 at the position of the stopper 44*a*, folds the sheets at the position of the stopper 44*b*, and outputs the sheets.

When proceeding to step S5004, the CPU 402 determines whether the center-folding binding process is set. When the determination is affirmative in step S5004, the CPU 402 proceeds to step S5005 whereas when the determination is negative in step S5004, the CPU 402 proceeds to step S5011.

In step S5005, the CPU 402 determines whether the "division binding" button has been pressed so that the division binding is executed.

When the determination is negative in step S5005, the CPU 402 proceeds to step S5009. In step S5009, the CPU 402 performs layout of pages in accordance with the method shown in FIG. 21. Then, the CPU 402 folds the sheets in a unit of five sheets at the position of the stopper 44*b* and outputs the sheets. As a result, the book shown in FIG. 23 is output. Note that, in this case, the binding process is not performed at the position of the stopper 44*a*.

On the other hand, when the determination is affirmative in step S5005, the CPU 402 proceeds to step S5010. In step S5010, the CPU 402 performs the binding process at the position of the stopper 44*a* in a unit of the predetermined number of sheets set in step S4007 by the user, folds the sheets at the position of the stopper 44*b*, and outputs the sheets. Note that, in this case, the binding process is not performed at the position of the stopper 44*a*.

After proceeding to step S5011, the CPU 402 performs layout for bookbinding and outputs the sheets while the binding process and the folding process are not performed. In this case, the sheets are not output to the sheet output tray 340 but output to the sheet output tray 328.

Since the sheets are folded in a unit of five sheets when the center-folding binding process is performed by the apparatus capable of executing the saddle-stitching binding process and the center-folding binding process by performing the control process as described above, a likelihood that jam occurs due to shift of the sheets which are being conveyed can be reduced. In other words, the number of sheets which can be simultaneously processed in the center-folding binding process is smaller than the number of sheets which can be simultaneously processed in the saddle-stitching binding process. Even when the apparatus has a system used to fold a predetermined number of sheets and the sheets are not bound but folded before output, the apparatus outputs the sheets in a unit of the number of sheets smaller than the predetermined number of sheets. In this way, likelihood that the folded sheets are shifted while the sheets are conveyed and jam of the sheets occurs can be reduced.

Furthermore, when the center-folding binding process is performed, the user can select one of two layout methods. In a first layout method, one of a plurality of booklets is inserted into another one of the plurality of booklets so that a book having pages arranged in an appropriate order is obtained. In a second layout method, a plurality of booklets are arranged so as to be adjacent to one another so that a book having pages arranged in an appropriate order is obtained. Since the user selects one of the two layout method, the user can obtain a book output in a desired format.

Furthermore, even when the user utilizes the division binding function while the center-folding binding process is executed by the control described above, a book which has pages arranged in an appropriate order similarly to the case when the saddle-stitching binding process is performed can be obtained. Specifically, the user is not required to perform a troublesome operation of dividing the sheets which have been arranged similarly to the case where the saddle-stitching binding process is performed and which have been output and sorting the sheets so that the pages are arranged in an appropriate order.

Note that in the foregoing embodiment, the sheet processing apparatus corresponds to the image forming apparatus 100 including the finisher 315. However, the sheet processing apparatus may not include a printing function and may only include a finisher capable of performing a center-folding binding process and a saddle-stitching binding process on sheets. In this case, the finisher may separately include a controller, a sheet-feeding unit which feeds sheets, and an operating unit which accepts an operation performed by the user, and may perform a center-folding binding process or a saddle-stitching binding process specified by the user on the sheets supplied from the sheet-feeding unit.

Furthermore, in the foregoing embodiment, the number of sheets which can be simultaneously processed in the saddle-stitching binding process is 25 and the number of sheets which can be simultaneously processed in the center-folding binding process is five. However, the number of sheets is not limited to these values. Furthermore, the upper limit value which can be input by the user is not limited to 25 in the case of the saddle-stitching binding process and 5 in the case of the center-folding binding process.

Note that the center-folding binding process described in the foregoing embodiment is also referred to as a saddle folded process.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A sheet processing apparatus comprising:

a sheet processing unit configured to perform a binding process and a folding process for a plurality of; and a control unit configured to control the sheet processing unit to perform, in a case where performing both the binding process and the folding process is designated for the plurality of sheets, both the binding process and the folding process in a unit of first number of sheets, wherein the control unit controls the sheet processing unit to perform, in a case where performing the folding process is designated but performing the binding process is not designated for the plurality of sheets, the folding process in a unit of a second number of sheets without performing the binding process, wherein the first number and the second number can be set by a user, and a settable maximum value of the number of sheets is more than a settable maximum value of the second number.

2. The sheet processing apparatus according to claim 1, wherein a process for performing both the binding process and the folding process is a saddle stitching binding process; and wherein a process for performing the folding process without performing the binding process is a center-folding process.

3. The sheet processing apparatus according to claim 1, further comprising:

a notifying unit configured to notify a user of a fact that the sheet processing unit performs, for the plurality of sheets, the folding process without performing the binding process in a unit of the second number of sheets.

4. The printing apparatus according to claim 1, wherein the sheet processing apparatus can be connected to a printing apparatus, and the sheet processing unit is configured to perform the binding process and the folding process for a plurality of sheets on which images are printed by the printing apparatus.

5. A method for controlling a sheet processing apparatus which comprises sheet processing unit for performing a binding process and a folding process for a plurality of sheets, comprising:

controlling the sheet processing unit to perform, in a case where performing both the binding process and the folding process is designated for a plurality of sheets, both the binding process and the folding process in a unit of the a first number of sheets; and controlling the sheet processing unit to perform, in a case where performing the folding process is designated but performing the binding process is not designated for the plurality of sheets, the folding process in a unit of second number of sheets without performing the binding process, wherein the first number and the second number can be set by a user, and a settable maximum value of the first number is more than a settable maximum value of the second number.

6. The method according to claim 5, wherein a process for performing both the binding process and the folding process is a saddle stitching binding process; and wherein a process for performing the folding process without performing the binding process is a center-folding process.

7. The method according to claim 5, further comprising:

notifying a user of a fact that the sheet processing unit performs, for the plurality of sheets, the folding process without performing the binding process in a unit of the second number of sheets.

8. A computer-readable storage medium for storing a computer program for controlling a sheet processing apparatus which comprises a sheet processing unit for performing a binding process and a folding process for a plurality of sheets the, computer program comprising:

a code to control the sheet processing unit to perform, in a case where performing both the binding process and the folding process is designated for the plurality of sheets of, both the binding process and the folding process in a unit of a first number of sheets; and a code to control the sheet processing unit to perform, in a case where performing the folding process is designated but performing the binding process is not designated for the plurality of sheets, the folding process in a unit of a second number of sheets without performing the binding process, wherein the first number and the second number can be set by a user, and a settable maximum value of the first number is more than a settable maximum value of the second number.

9. A sheet processing apparatus comprising:

a sheet processing unit configured to perform a binding process and a folding process for a plurality of sheets; and a setting unit configured to set, according to a user operation, a first limit number for performing both the binding process and the folding process and a second limit number for performing the folding process without performing the binding process, wherein a settable maximum value of the first limit number is more than a settable maximum value of the second limit number.

10. A method for controlling a sheet processing apparatus which comprises a sheet processing unit for performing a binding process and a folding process for a plurality of sheets, comprising:

setting, according to a user operation, a first limit number for performing both the binding process and the folding process, and setting, according to a user operation, a second limit number for performing the folding process without performing the binding process, wherein a settable maximum value of the first limit number is more than a settable maximum value of the second limit number.

11. A computer-readable storage medium for storing a computer program for controlling a sheet processing apparatus which comprises a sheet processing unit for performing a binding process and a folding process for a plurality of sheets, the computer program comprising:

a code to set, according to a user operation, a first limit number for performing both the binding process and the folding process, and a code to set, according to a user operation, a second limit number for performing the folding process without performing the binding process, wherein a settable maximum value of the first limit number is more than a settable maximum value of the second limit number.

* * * * *